US008328192B2

(12) United States Patent
Yamazaki et al.

(10) Patent No.: US 8,328,192 B2
(45) Date of Patent: Dec. 11, 2012

(54) SHEET THICKNESS DETECTION DEVICE AND IMAGE FORMING APPARATUS

(75) Inventors: Yoshitaka Yamazaki, Abiko (JP); Taishi Tomii, Toride (JP)

(73) Assignee: Canon Kabushiki Kaisha (JP)

( * ) Notice: Subject to any disclaimer, the term of this patent is extended or adjusted under 35 U.S.C. 154(b) by 75 days.

(21) Appl. No.: 13/034,102

(22) Filed: Feb. 24, 2011

(65) Prior Publication Data

US 2011/0210506 A1 Sep. 1, 2011

(30) Foreign Application Priority Data

Feb. 26, 2010 (JP) ..... 2010-042450

(51) Int. Cl.
*B65H 7/02* (2006.01)

(52) U.S. Cl. ..... 271/265.04; 271/274; 271/262; 271/263

(58) Field of Classification Search ..... 271/265.04, 271/265.02, 262, 263, 274
See application file for complete search history.

(56) References Cited

U.S. PATENT DOCUMENTS

| | | | | |
|---|---|---|---|---|
| 5,437,445 | A | 8/1995 | Chang et al. | |
| 5,727,692 | A | 3/1998 | Large et al. | |
| 7,355,763 | B2 * | 4/2008 | Furihata | 358/474 |
| 2003/0160081 | A1 * | 8/2003 | Lim et al. | 226/187 |
| 2005/0184455 | A1 * | 8/2005 | Youn | 271/274 |
| 2008/0012216 | A1 * | 1/2008 | Tsukamoto et al. | 271/265.01 |
| 2008/0265499 | A1 * | 10/2008 | Sugiyama | 271/262 |
| 2011/0262152 | A1 * | 10/2011 | Koizumi | 399/16 |

FOREIGN PATENT DOCUMENTS

| | | | |
|---|---|---|---|
| JP | 04-182244 | A | 6/1992 |
| JP | 2872022 | B2 | 3/1999 |
| JP | 2004-256293 | A | 9/2004 |
| JP | 2008-254855 | A | 10/2008 |

OTHER PUBLICATIONS

Tomii, Taishi. "Sheet Thickness Detection Device and Image Forming Apparatus," Specification and Drawings of unpublished related co-pending U.S. Appl. No. 13/034,087, filed Feb. 24, 2011, pp. 1-74.

* cited by examiner

*Primary Examiner* — Prasad Gokhale
(74) *Attorney, Agent, or Firm* — Rossi, Kimms & McDowell LLP

(57) ABSTRACT

A sheet thickness detection device capable of accurately detecting a thickness of sheets of various types. In a case that information about sheets stored in a sheet feed unit is set by a user through an operation unit or through an external host PC, a CPU of the sheet thickness detection device sets a pressure changeover solenoid to ON to obtain a strong nip pressure between a detection roller and a fixed roller, if a sheet basis weight specified in the information about sheets is larger than a predetermined value, and sets the pressure changeover solenoid to OFF to obtain a weak nip pressure, if the sheet basis weight specified in the information about sheets is equal to or less than the predetermined value.

21 Claims, 21 Drawing Sheets

SHEET THICKNESS DETECTION DEVICE AND IMAGE FORMING APPARATUS

BACKGROUND OF THE INVENTION

1. Field of the Invention

The present invention relates to a sheet thickness detection device for detecting a thickness of a sheet being conveyed, and an image forming apparatus mounted with the sheet thickness detection device.

2. Description of the Related Art

An image forming apparatus such as a printer and a multifunction peripheral is supplied with, e.g., normal sheets or coated sheets from a sheet feeding apparatus disposed inside or outside the image forming apparatus, forms images on respective ones of the supplied sheets, and then outputs these sheets as printed products. In some image forming apparatus, a sheet property (e.g., sheet thickness) is detected to stably form high-quality images.

The sheet feeding apparatus incorporates a storage container in which sheets are stored, and is configured to separate and feed sheets one by one from the storage container to the image forming apparatus.

However, two or more sheets are sometimes conveyed together due to separation failure (hereinafter, referred to as the multiple feed). In that case, there is a fear in electrographic image formation that an image failure or a fixing failure occurs when a toner image is transferred and fixed to a sheet and a conveyance failure occurs due to increase in conveyance resistance in a conveyance path of the sheet feeding apparatus or of the image forming apparatus.

To prevent occurrences of these failures, a multiple feed detection system has been proposed that detects multiple sheet feed by using, e.g., an optical sensor. This multiple feed detection system detects a thickness of a sheet being conveyed to thereby discriminate between single sheet conveyance and multiple sheet conveyance.

In electrographic image formation, the thermal capacity of a sheet (an amount of heat removed by the sheet) varies depending on the thickness of the sheet, so that an amount of heat applied to a toner image on the sheet becomes unstable, resulting in a problem of fixing property. To ensure the fixing property, it is necessary to grasp the sheet thickness and to apply the toner image on the sheet with an amount of heat determined by taking account of the sheet thickness.

With a conventional image forming apparatus, the amount of heat applied to the toner image is varied according to sheet thickness information input by a user to the image forming apparatus, whereby a stable fixing property is ensured.

As described above, the electrographic image forming apparatus and the sheet feeding apparatus require a sheet thickness detection apparatus capable of detecting the sheet thickness in order to prevent multiple sheet feed and image failure and to ensure a stable fixing property.

To meet the above demand, a paper sheet thickness detection mechanism disclosed in, e.g., Japanese Patent Publication No. 2872022 has a conveyance path on which there are provided a process start trigger sensor for detecting a paper sheet and for starting a thickness detection process and a detection roller disposed apart from a fixed reference roller by a distance corresponding to paper sheet thickness. The detection roller is displaced according to the thickness of a sheet that runs to the reference roller. If a paper sheet which is excessively large in thickness is fed or if multiple paper sheets are fed simultaneously, the detection roller is largely displaced.

When the detection roller is displaced according to paper sheet thickness, the amount of displacement of the detection roller is enlarged by a gear ratio and an arm ratio, and the enlarged displacement is conveyed to a scale formed with slits which are vertically arranged at equal intervals. An encoder counts light and dark slits and outputs rectangular pulses which are the same in number as the number of counts. By measuring the output of the encoder, it is possible to detect a sheet thickness or the number of multiple sheets fed simultaneously. However, the conventional sheet thickness detection device entails the following problems.

In recent electrophotographic image forming apparatuses such as copying machines and multifunction peripherals, especially in printers, there are a variety of types of sheets being conveyed.

First, the sheet thickness varies in an extremely wide range from 38 g/m$^2$ to 350 g/m$^2$ in terms of sheet basis weight. For a sheet which is small in basis weight and thickness and has small rigidity, there is a fear that the sheet is bent at its end portion and wrinkled by a conveyance roller during being conveyed, which requires that the arrangement for conveyance be configured taking into account this point.

Secondly, the sheet size in conveyance direction varies in a range from B5 (182 mm) to 18 inch (about 460 mm). In a high-speed image forming apparatus where sheet conveyance is performed at a high speed (e.g., 1300 mm/sec), a time available for sheet thickness detection is extremely short unless the sheet conveyance is stopped or decelerated. Accordingly, it is necessary that the apparatus be configured taking into account the response in sheet thickness detection.

However, the paper sheet detection apparatus heretofore proposed is configured to apply a constant roller nip pressure to a sheet between the detection roller and the reference roller. Therefore, in an arrangement configured to apply a nip pressure that enables conveyance of sheets having a relatively large basis weight (e.g., about 150 g/m$^2$), the following problems are caused in conveying sheets having a small basis weight (e.g., 52 g/m$^2$). Since the rigidity of a sheet which is small in basis weight is insufficient to withstand the nip pressure between the detection roller and the reference roller, the sheet is curled at its end or the entire sheet is wrinkled, which results in conveyance failure or results in deteriorated product quality.

On the other hand, in an arrangement configured to apply a nip pressure that enables conveyance of sheets having a relatively small basis weight (e.g., about 52 g/m$^2$), the following problems are caused in conveying sheets having a large basis weight (e.g., 300 g/m$^2$). Since the nip pressure between the detection roller and the reference roller becomes too small for sheets with a large basis weight and with a strong rigidity, the detection roller vibrates due to strong sheet rigidity, so that a long time is required to obtain a stabilized sensor output, which results in a remarkable reduction in response. As a result, there is a fear that sheet thickness is erroneously detected.

SUMMARY OF THE INVENTION

The present invention provides a sheet thickness detection device and an image forming apparatus, which are capable of accurately detecting a thickness of sheets of various types.

According to one aspect of this invention, there is provided a sheet thickness detection device for detecting a thickness of a sheet being conveyed, which comprises a conveyance unit configured to convey a sheet along a conveyance path, an acquisition unit configured to acquire information about the sheet being conveyed, a driven member disposed in the conveyance path for contact with the sheet being conveyed and configured to be displaced to follow a thickness of the sheet being conveyed, a pressure changeover unit configured to change a pressure applied by the driven member to the sheet being conveyed, a displacement amount detection unit configured to detect an amount of displacement of the driven member, a thickness computation unit configured to compute the thickness of the sheet being conveyed based on a result of detection by the displacement amount detection unit, and a control unit configured, based on the sheet information acquired by the acquisition unit, to control the pressure changeover unit to change the pressure applied by the driven member to the sheet.

Other aspects of the present invention will become apparent from the following description of exemplary embodiments with reference to the attached drawings.

DESCRIPTION OF THE EMBODIMENTS

The present invention will now be described in detail below with reference to the drawings showing preferred embodiments thereof.

First Embodiment

Figure 1:
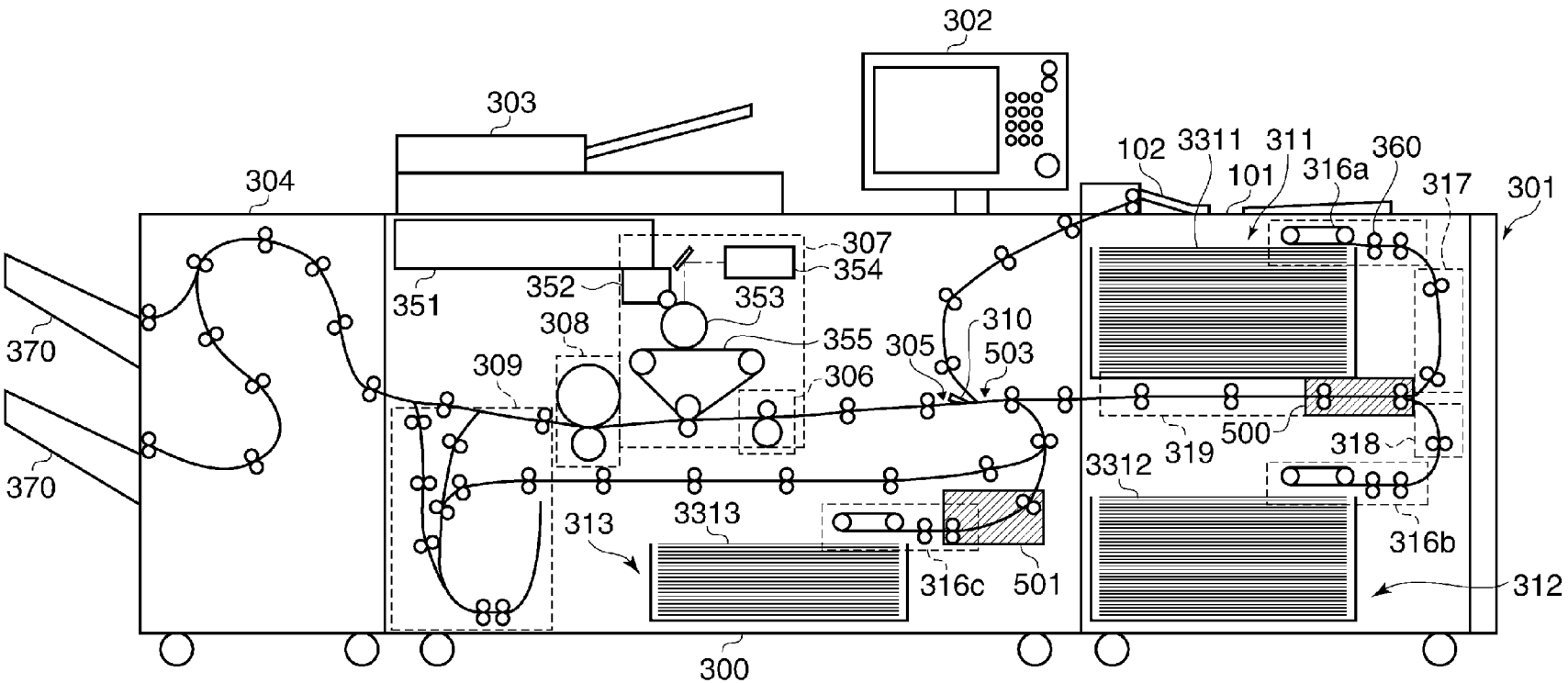
FIG. 1 is a view showing the construction of an image forming system mounted with sheet thickness detection devices according to a first embodiment of this invention.

FIG. 1 shows the construction of an image forming system mounted with sheet thickness detection devices according to a first embodiment of this invention. The image forming system includes an image forming apparatus 300, sheet feeding apparatus 301, operation unit 302, reader scanner 303, and post-processing apparatus 304.

The image forming system performs sheet feeding, sheet conveyance, image formation, and post-processing based on sheet process settings set by a user through the operation unit 302 or through an external host PC (not shown) and image information transmitted from the reader scanner 303 or from the external host PC.

The sheet feeding apparatus 301 of the image forming system includes two-tier sheet feed units 311, 312 respectively mounted with storage containers 3311, 3312 (storage units) in which sheets are stored and from which sheets are fed, as required.

On a top surface of the sheet feeding apparatus 301, there are provided an escape sheet discharging tray 101 to which abnormal sheets caused by multiple feeding, sheet jam, or the like are forcibly discharged, and an escape sheet-full detection device 102 for detecting the escape sheet discharging tray 101 becoming full of sheets. Conveyance sensors (not shown) for detecting sheet passage are provided in conveyance paths.

For sheet feeding, sheet feeding conveyance units 316*a*, 316*b* are provided in the sheet feed units 311, 312. Further, a sheet feeding conveyance unit 316*c* is provided in a sheet feed unit 313 of the image forming apparatus 300.

In this embodiment, the sheet feeding conveyance units 316*a*, 316*b* and 316*c* each include a fan (not shown) for control of air sheet feed. During the sheet feeding, the fan is driven to feed air into between sheets in the storage containers 3311, 3312 or 3313 from an upstream side in the sheet conveyance direction. Sheets in the storage container are separated from one another and then fed and conveyed one by one, while an uppermost sheet being sucked to an endless belt of the unit 316*a*, 316*b* or 316*c* by a sheet suction fan provided in the endless belt.

In the sheet feed unit 311, a sheet conveyed by the endless belt of the sheet feeding conveyance unit 316*a* is further conveyed by a conveyance unit 317 toward a conveyance unit 319 with which the conveyance unit 317 merges. In the sheet feed unit 312, a sheet conveyed by the endless belt of the sheet feeding conveyance unit 316*b* is further conveyed by a conveyance unit 318 toward the conveyance unit 319 with which the conveyance unit 318 merges. The conveyance unit 319 is provided with a sheet thickness detection device 500 for sequentially detecting thicknesses of sheets, which are fed and conveyed from the sheet feed unit 311 or 312.

Figure 2:
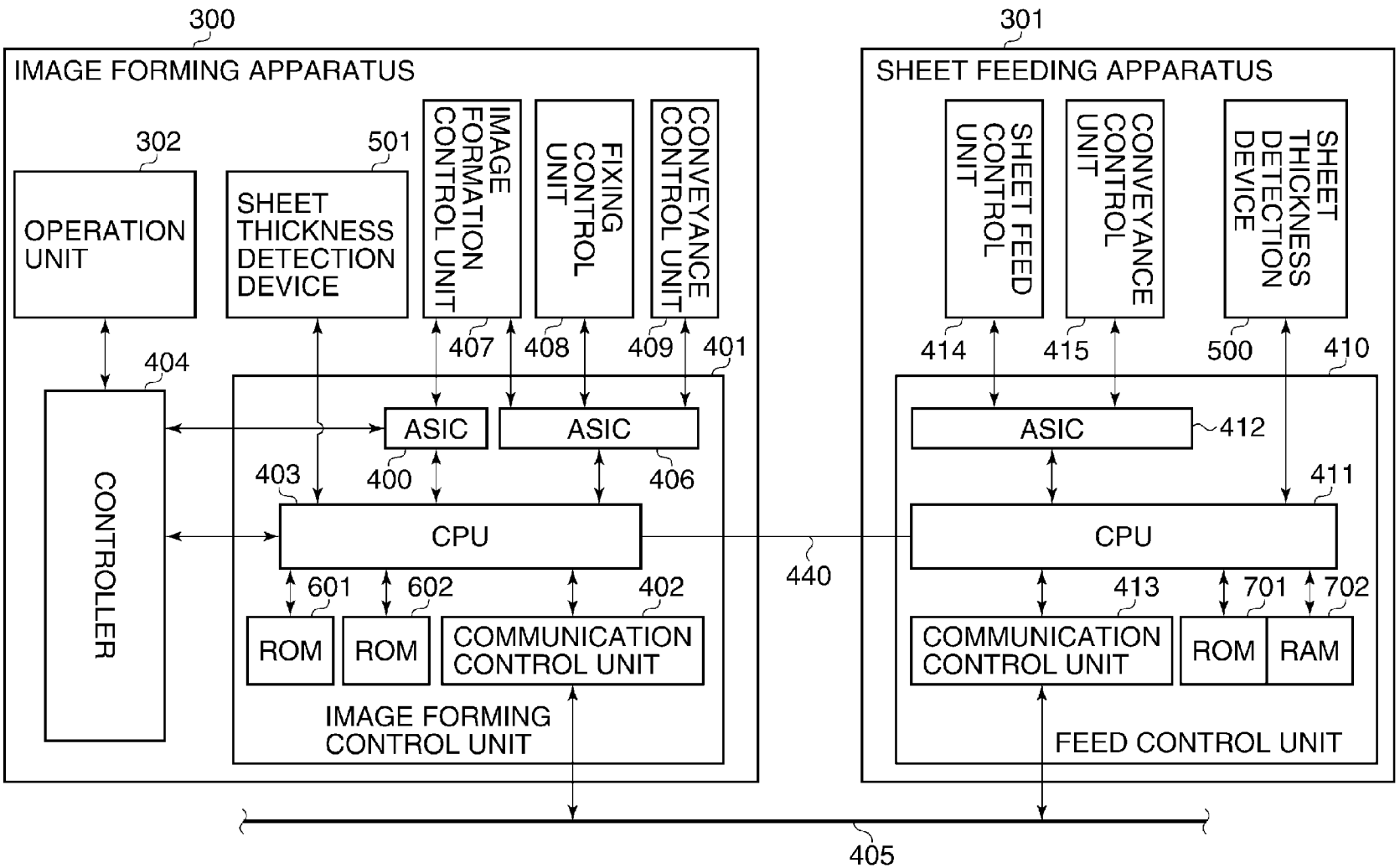
FIG. 2 is a block diagram showing the construction of a sheet conveyance control system of the image forming system.

The conveyance units 317 to 319 each include a stepping motor controlled by a conveyance control system shown in FIG. 2 and conveyance rollers 360 rotated for sheet conveyance by the stepping motor.

In response to a sheet supply request from the image forming apparatus 300, the sheet feeding apparatus 301 sequentially feeds and conveys sheets from the storage container 3311 or 3312, and notifies the image forming apparatus of completion of preparation each time a sheet reaches a waiting position at a downstreammost end of the conveyance unit 319.

Upon receipt of the preparation completion notification from the sheet feeding apparatus 301, the image forming apparatus 300 notifies a delivery request. The sheet feeding apparatus 301 discharges the sheet from the waiting position to the image forming apparatus 300 each time the delivery request is notified. The image forming apparatus 300 receives sheets one by one and forms an image on the received sheet. The sheet feeding apparatus 301 stops operation and enters a standby state after discharging the requested number of sheets.

On the top of the image forming apparatus 300, there are disposed the operation unit 302 through which the user performs operation settings of the image forming system, and the reader scanner (reader unit) 303 for reading an image of an original.

The image forming apparatus 300 receives a sheet from the sheet feed unit 311 or 312 of the sheet feeding apparatus 301 or from the sheet feed unit 313 of the image forming apparatus 300, and controls the conveyance unit for sheet conveyance.

In the image forming apparatus 300, a sheet thickness detection device 501 for sequentially detecting thicknesses of sheets fed and conveyed from the sheet feed unit 313 is disposed along a conveyance path extending from the sheet feed unit 313 to an image forming unit 307. The sheet feed unit 313 is the same in construction as the sheet feed units 311, 312, and a description thereof will be omitted. The sheet thickness detection device 501 has the same construction as that of the sheet thickness detection device 500 of the sheet feeding apparatus 301.

According to a result of sheet thickness detection by the sheet thickness detection device 500 or 501, operation of a flapper 310 of the image forming apparatus 300 is controlled. If the detected sheet thickness is abnormal, the flapper 310 is controlled to select a conveyance path to the escape sheet discharging tray 101, whereby the corresponding sheet is discharged to the tray 101.

If the detected sheet thickness is normal, the flapper 310 is controlled to select a conveyance path to the image forming unit 307, whereby the corresponding sheet is conveyed to the unit 307. The image forming unit 307 performs image formation based on received image data triggered by sheet detection by a reference sensor 305.

The image forming unit 307 includes a developing unit 352, photosensitive drum 353, laser scanner unit 354, and intermediate transfer belt 355. The image forming unit 307 performs light amount control such as lighting a semiconductor laser in the laser scanner unit 354 and controls a scanner motor to rotatably drive a polygon mirror (not shown), whereby laser light is irradiated onto the photosensitive drum 353 according to image data and a latent image is formed on the photosensitive drum 353.

In the image forming unit 307, the latent image on the photosensitive drum 353 is developed into a toner image by a developing unit 352 to which toner is supplied from a toner bottle 351. The toner image on the photosensitive drum 353 is transferred to an intermediate transfer belt 355 and further transferred from the transfer belt 355 to a sheet.

A registration control unit 306 disposed short of a position where the toner image is transferred to a sheet performs an inclination correction to the sheet located at a position immediately short of the transfer position, without stopping sheet conveyance, and performs sheet conveyance control to finely adjust and match a position of the leading end of the sheet to the toner image formed on the intermediate transfer belt 355.

The sheet onto which the toner image has been transferred is conveyed to a fixing device 308 that applies heat and pressure to the sheet to fuse toner, thereby fixing the toner image onto the sheet. At that time, a controlled temperature of the fixing device 308 is determined according to the result of detection by the sheet thickness detection device 500 or 501. Specifically, the controlled temperature of the fixing device 308 is set to be lower than a normal temperature, if the sheet thickness is thin, whereas the controlled temperature is set to be higher than the normal temperature, if the sheet thickness is thick, thereby capable of preventing a fixing failure which would be caused by heat loss due to heat capacity of the sheet and an image failure due to, e.g., gross reduction in the fixed image which would be caused by excessive heat being applied to the toner.

If printing should be made on a rear surface of the sheet or if the sheet should be reversed from front to back, the sheet onto which the toner image has been fixed is conveyed to an inversion conveyance unit 309. On the other hand, if printing should be completed, the sheet is conveyed to the post-processing apparatus 304.

The post-processing apparatus 304 is disposed downstream of the image forming apparatus 300 and performs the desired post-processing (such as folding, stapling, or punching) set by the user through the operation unit 302 on sheets on which images have been formed. A resultant product (i.e., sheets for which the post-processing has been made) is discharged to one of sheet discharge trays 370 and provided to the user.

FIG. 2 shows in block diagram the construction of a sheet conveyance control system of the image forming system. A job request is made by the user to the image forming apparatus 300 from the operation unit 302 or from an external PC via a network (not shown) or the like.

At the time of copying, image information is sent from the reader unit 303 to a controller 404 of the image forming apparatus 300. At the time of printing, image information is sent from the network to the controller 404. The image information sent to the controller 404 is subjected to image processing specified by the user or subjected to image processing to convert the image information into an image form suited to the image forming apparatus 300.

Along with image data on which image processing has been made, various status information (such as image size information, page information, sheet feed unit information, post-processing information) is transmitted from the controller 404 to an image forming control unit 401 of the image forming apparatus 300.

The sheet feed unit information corresponds to sheets designated (as being used in the job) by the user via the operation unit 302, network or the like.

As a preparatory process for the sheet designation, information representing sheets stored in the sheet feed units 311 to 313 is specified in advance by the user before execution of the job. The sheet information represents sizes, basis weights, and surface properties of sheets stored in the sheet feed units 311 to 313. The sheet information is notified via the controller 404 to and stored into the image forming control unit 401 of the image forming apparatus 300 and the feed control unit 410 of the sheet feeding apparatus 301.

The image forming apparatus 300, the sheet feeding apparatus 301, and the post-processing apparatus 304 are connected to one another via a bus 405, which is implemented by a serial bus capable of providing multiple connection, such as I2C or ARCNET (registered trademark).

A signal line for a delivery timing signal 440 is connected between the image forming apparatus 300 and the sheet feeding apparatus 301. The delivery timing signal 440 provides a trigger for sheet delivery and conveyance from the sheet feeding apparatus 301 to the image forming apparatus 300.

The sheet delivery and conveyance is controlled by the feed control unit 410 of the sheet feeding apparatus 301. The speed of delivery and conveyance triggered by the delivery timing signal 440 is the same as the conveyance speed in the image forming apparatus 300, which is set to a maximum speed at or below which the desired quality of image formation such as fixing property and transfer property can be satisfied. Since the sheet feeding apparatus 301 is less subjected to such restriction, sheets can be conveyed at a higher speed in the sheet feeding apparatus 301 than in the image forming apparatus 300.

Since a control unit of the post-processing apparatus 304 is unnecessary to be described in detail in relation to this invention, a description thereof is omitted.

The image forming control unit 401 is provided with a CPU 403. The CPU 403 is connected by communication to the controller 404, exchanges status information with the controller 404, and controls via an ASIC 400 image data exchange with the controller 404 and the timing of the image data exchange.

The CPU 403 is connected via the communication control unit 402 to the bus 405, controls acquisition of status information from the sheet feeding apparatus 301, and controls sheet conveyance. The CPU 403 supplies control commands via an ASIC 406 to respective units of the image forming apparatus 300 (such as the image formation control unit 407, fixing control unit 408, and conveyance control unit 409), detects states of these units, and controls image formation and sheet conveyance for the image formation. The image formation control unit 407 controls respective units of the image forming unit 307.

The ASIC 400 converts image data supplied from the controller 404 into a laser control signal, delivers the laser control signal, and performs light amount control such as lighting a semiconductor laser in the laser scanner unit 354.

The ASIC 406 sends control instructions to control rotation of the scanner motor (not shown) of the image forming unit 307, toner supply from the toner bottle 351, developing by the developing unit 352, transfer to the intermediate transfer belt 355, and transfer of a toner image to a sheet.

Based on control instructions supplied from the ASIC 406, the conveyance control unit 409 performs sheet conveyance control in the image forming apparatus 300 such as sheet inclination correction in the registration control unit 306, position control of sheet leading end and toner image in the registration control unit 306, sheet feed control in the storage container 3313 of the sheet feed unit 313, and sheet feed control in the sheet feeding conveyance unit 316*c* of the sheet feed unit 313. The fixing control unit 408 controls a heater temperature adjustment based on a temperature detected in the fixing device 308.

The sheet thickness detection device 501 is connected to the CPU 403 and outputs to the CPU 403 an output value representing a sheet thickness. The CPU 403 adjusts the output of the sheet thickness detection device 501.

A ROM 601 is connected to the CPU 403. The ROM 601 stores a control program for the CPU 403 and stores initial setting values and control values used by the ASICs 400, 406 to control respective parts of the image forming apparatus 300. The ROM 601 stores in advance property tables such as a set basis weight-to-sheet thickness conversion table (see FIG. 3) and a sheet thickness detection device output-to-sheet thickness conversion table (see FIG. 4). A RAM 602 is also connected to the CPU 403 and used to store, e.g., adjustment values for the sheet thickness detection devices. The RAM 602 is implemented by a nonvolatile memory battery backed up when power supply to the apparatus is turned off.

Figure 3:
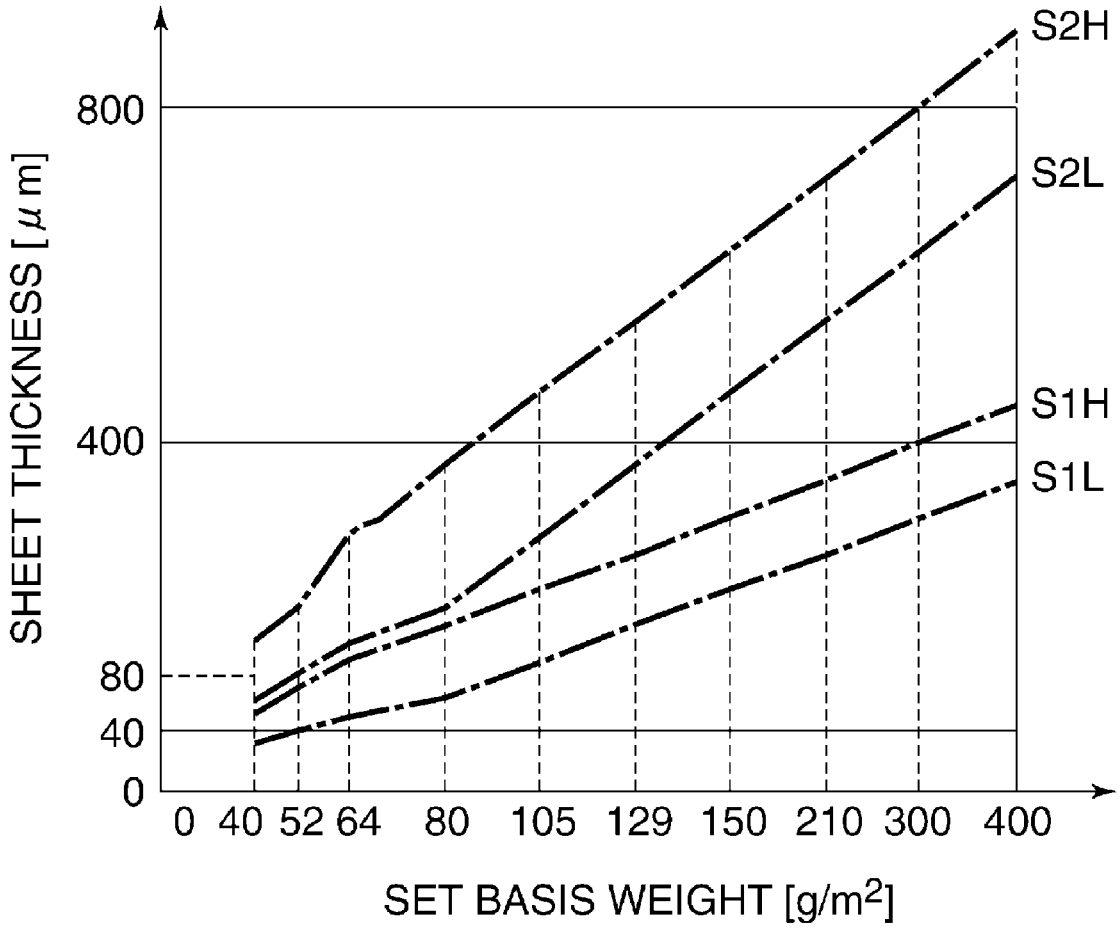
FIG. 3 is a graph showing a relation between set basis weight and sheet thickness.

FIG. 3 is a graph showing a relation between set basis weight and sheet thickness. The relation shown by the graph (i.e., a set basis weight-to-sheet thickness conversion table) is used to convert a basis weight of sheets stored in each of the sheet feed units into a sheet thickness.

The sheet basis weight is part of sheet information manually set by the user for sheets stored in each sheet feed unit through the operation unit 302 or through the external host PC. The sheet information includes, e.g., pieces of information representing a basis weight, size, and surface property of sheets. Sheet basis weight is in proportion to sheet thickness. A sheet thickness corresponding to a sheet basis weight can be determined based on the conversion table shown in FIG. 3. In setting the sheet information, sheet thickness information can be set instead of basis weight information.

As shown in FIG. 3, the set basis weight-to-sheet thickness table includes a set basis weight-to-sheet thickness conversion table at the time of single sheet conveyance and a set basis weight-to-sheet thickness conversion table at the time of double sheet conveyance. A sheet thickness range represented by symbols S1L, S1H is set in the conversion table at the time of single sheet conveyance, and a sheet thickness range represented by symbols S2L, S2H is set in the conversion table at the time of double sheet conveyance.

Figure 4:
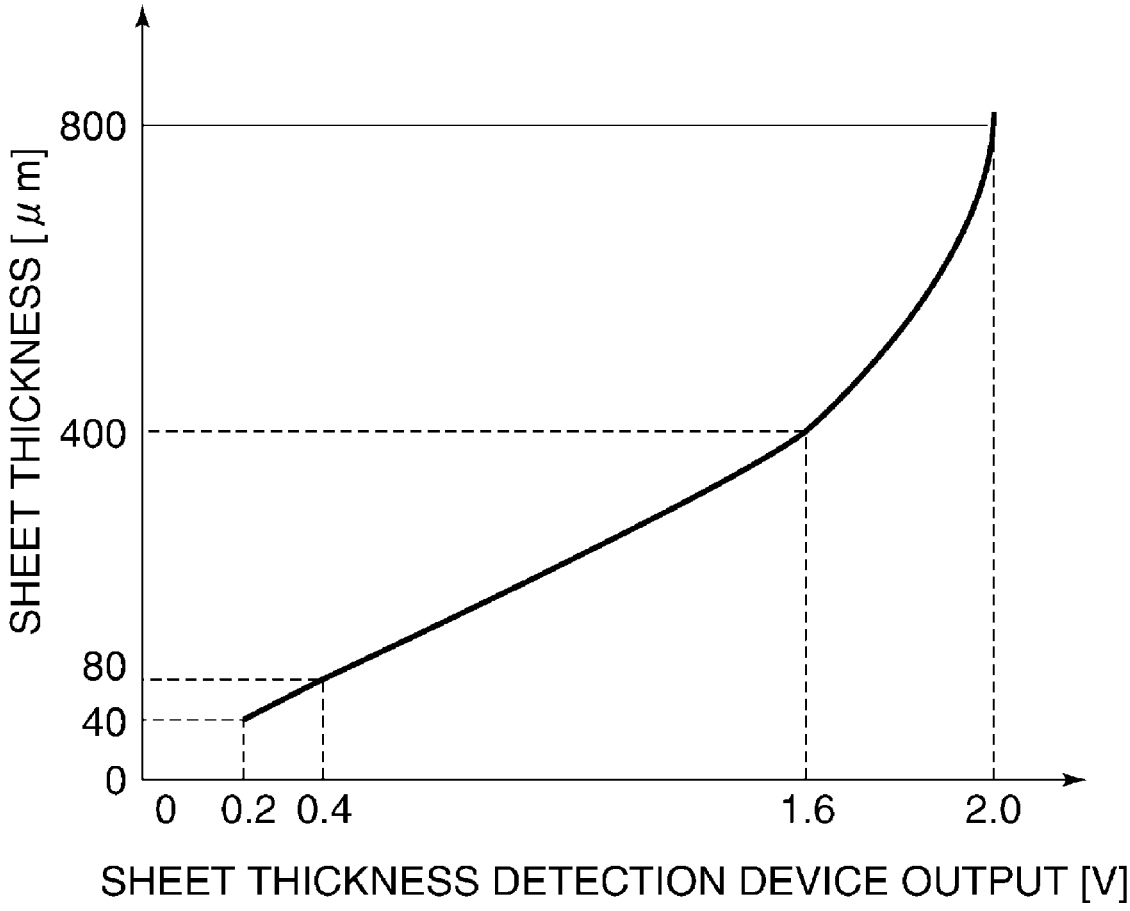
FIG. 4 is a graph showing a relation between sheet thickness detection device output and sheet thickness.

FIG. 4 is a graph showing a relation between sheet thickness detection device output and sheet thickness. The relation shown in the graph (i.e., a sheet thickness detection device output-to-sheet thickness conversion table) represents an output characteristic, which is determined in advance, of the sheet thickness detection device with respect to amount of displacement of a swing member, described later, of the detection device (i.e., with respect to sheet thickness). At the time of sheet thickness detection, the conversion table is used to convert an output of the sheet thickness detection device into a sheet thickness.

More specifically, as shown in an output waveform (see FIG. 15) of a magnetic sensor of the sheet thickness detection device 500, the output of the detection device 500 corresponds to an absolute difference value $\Delta V$ between an initial sensor output value V0 and a sensor output value V1 at the sheet thickness detection.

Referring to FIG. 2 again, the sheet feeding apparatus 301 includes a sheet feed control unit 414 and a conveyance control unit 415 as well as the feed control unit 410 and the sheet thickness detection device 500. The sheet feed control unit 410 controls sheet feeding based on all loads of the sheet feeding apparatus 301 and sensor information.

The feed control unit 410 includes a CPU 411 that inputs the delivery timing signal 440 from the image forming apparatus 300 and is triggered by the signal 440 to control sheet delivery and conveyance from the sheet feeding apparatus 301 to the image forming apparatus 300. Further, the CPU 411 controls sheet conveyance in the sheet feeding apparatus 301 and exchanges, via a communication control unit 413, status information with, e.g., the image forming apparatus 300 connected to the bus 405.

The sheet feed control unit 414 controls sheet feeding by the sheet feeding conveyance units 316*a*, 316*b* from the sheet feed units 311, 312. Based on control instructions supplied from an ASIC 412, the sheet feed control unit 414 controls detection by sensors disposed in the storage containers 3311, 3312 of the sheet feed units 311, 312 and in the sheet feeding conveyance units 316*a*, 316*b* of the sheet feeding apparatus 301 and controls drive of motors (not shown).

Based on control instructions supplied from the ASIC 412, the conveyance control unit 415 controls reception of sheets by the conveyance unit 317 or 318 from the sheet feeding conveyance unit 316*a* or 316*b* and controls sheet conveyance in the conveyance units 317, 318 and 319.

The sheet thickness detection device 500 is connected to the CPU 411 and outputs to the CPU 411 an output value corresponding to sheet thickness. The CPU 411 adjusts the output of the sheet thickness detection device 500.

A ROM 701 is connected to the CPU 411. In the ROM 701, there are stored a control program for the CPU 411 and initial setting values and control values used by the ASIC 412 to control the sheet feed control unit 414 and the conveyance control unit 415. Property tables (see FIGS. 3 and 4) for the sheet thickness detection device 500 are stored in advance in the ROM 701. A RAM 702 is also connected to the CPU 411 and used to store, e.g., adjustment values for the sheet thickness detection device 500. The RAM 702 is implemented by a nonvolatile memory, which is battery-backed up when power supply to the apparatus is turned off.

Next, a description will be given of operations of the image forming apparatus 300 and the sheet feeding apparatus 301 of the image forming system having the above-described construction. At power on, the image forming system performs an initial operation and then enters a standby state in which a sheet conveyance control process described below is started.

Figure 5:
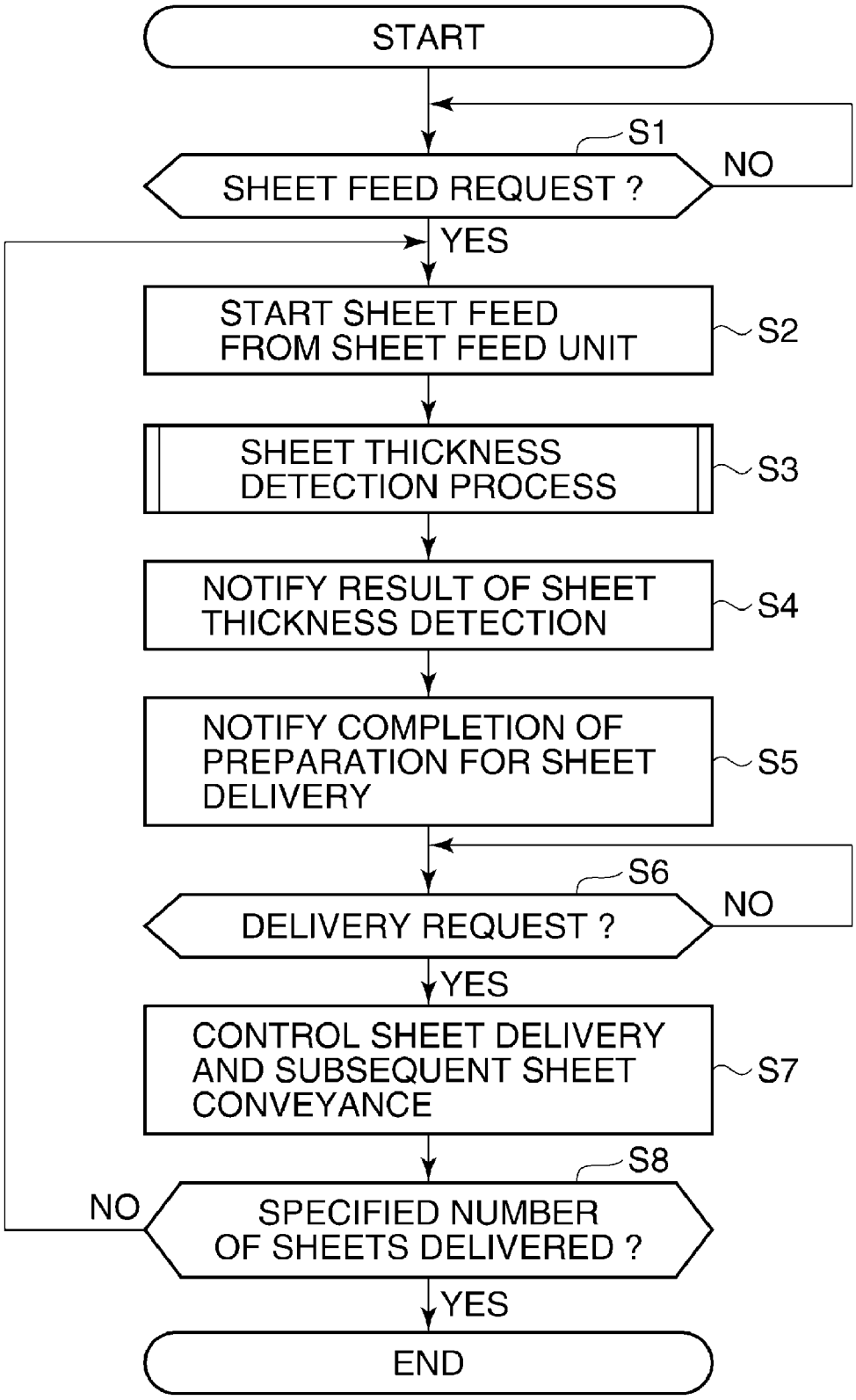
FIG. 5 is a flowchart showing procedures of a sheet conveyance control process performed by a sheet feeding apparatus.

FIG. 5 shows in flowchart the procedures of the sheet conveyance control process performed by the CPU 411 of the sheet feeding apparatus 301. A program for the control process is stored in the ROM 701 and executed by the CPU 411. At power-on, the CPU 411 performs initial adjustment control, e.g., to check for apparatus error, alarm status, and amount of residual sheets and to adjust fan air volume. Subsequently, the CPU 411 shifts the sheet feeding apparatus 301 to a standby state.

The CPU 411 of the sheet feeding apparatus 301 waits for reception of a sheet feed request from the CPU 403 of the image forming apparatus 300 via the bus 405 (step S1). When receiving a sheet feed request, the CPU 411 causes, via the ASIC 412, the sheet feed control unit 414 to start sheet feed from a sheet feed unit specified in the sheet feed request (step S2). Specifically, control signals for fan control and conveyance motor control are output to the sheet feed control unit 414, so that sheets are separated and conveyed one by one from either the storage container 3311 or 3312 by the sheet feeding conveyance unit 316*a* or 316*b*. When a sheet is conveyed to the sheet thickness detection device 500 disposed in an upstream part of the conveyance unit 319, the CPU 411 starts a sheet thickness detection process, which will be described later (step S3).

Next, the CPU 411 receives an output from the sheet thickness detection device 500, converts the received output into a sheet thickness, and notifies the sheet thickness to the CPU 403 of image forming apparatus 300 via the bus 405 (step S4). Then, the CPU 411 causes the conveyance unit 319 to convey a sheet up to a downstreammost end of the unit 319. When the sheet reaches the downstreammost end, the CPU 411 temporarily stops the sheet conveyance and notifies the CPU 403 of the image forming apparatus 300 that preparation for sheet delivery is completed (step S5). Subsequently, the CPU 411 waits for reception of a delivery request from the CPU 403 in the form of a delivery timing signal 440 (step S6). When receiving the delivery request, the CPU 411 controls deliver of the sheet to the image forming apparatus 300 and controls conveyance of a subsequent sheet (step S7). Then, the CPU 411 determines whether a specified number of sheets (specified in the sheet feed request) have been delivered (step S8). If the answer to step S8 is NO, the flow returns to step S2. On the other hand, if the specified number of sheets specified in the sheet feed request have been delivered, the CPU 411 shifts the sheet feeding apparatus 301 to a waiting state (standby state), and completes the present process.

Figure 6:
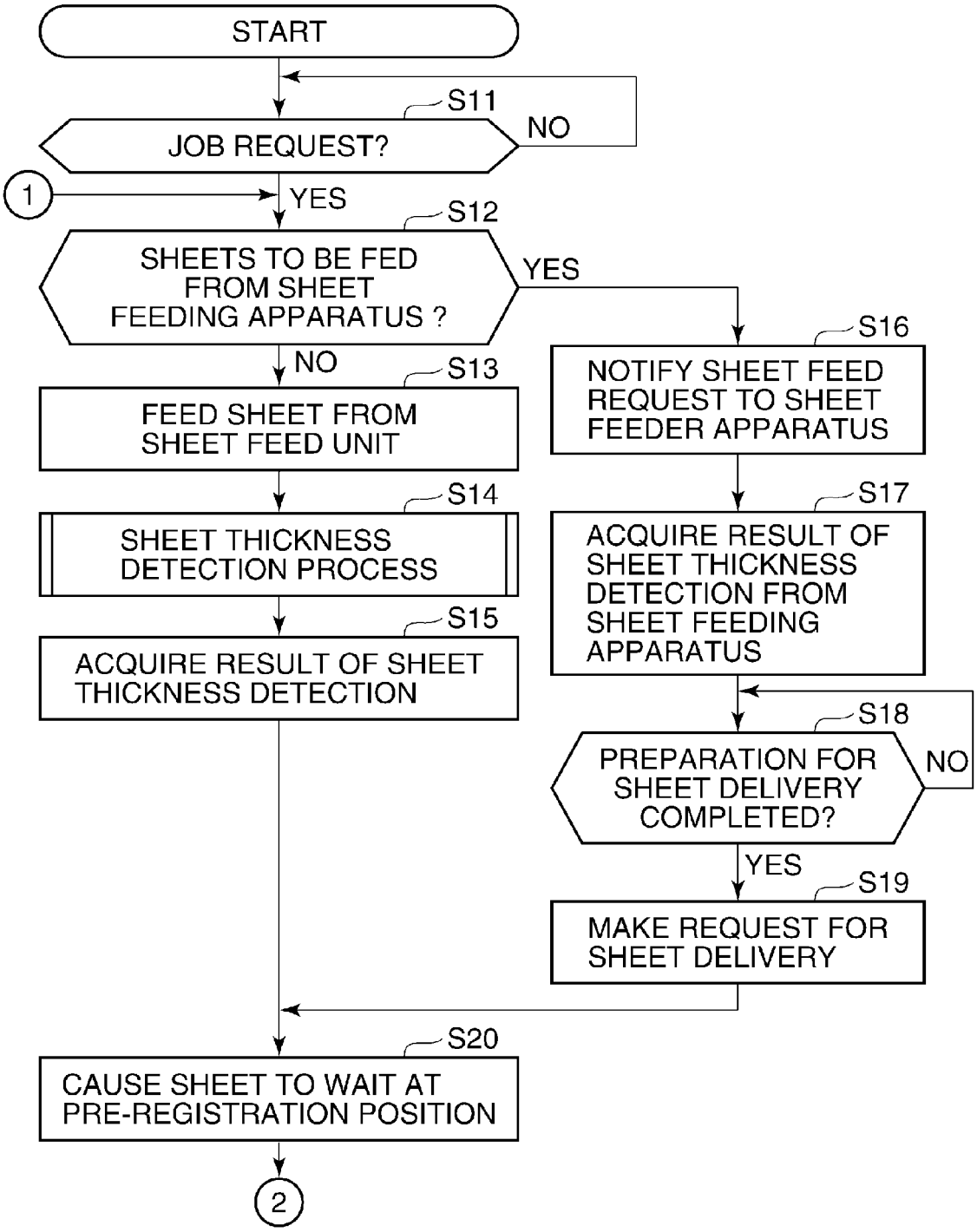
FIG. 6 is a flowchart showing apart of procedures of image forming control process performed by an image forming apparatus.
Figure 7:
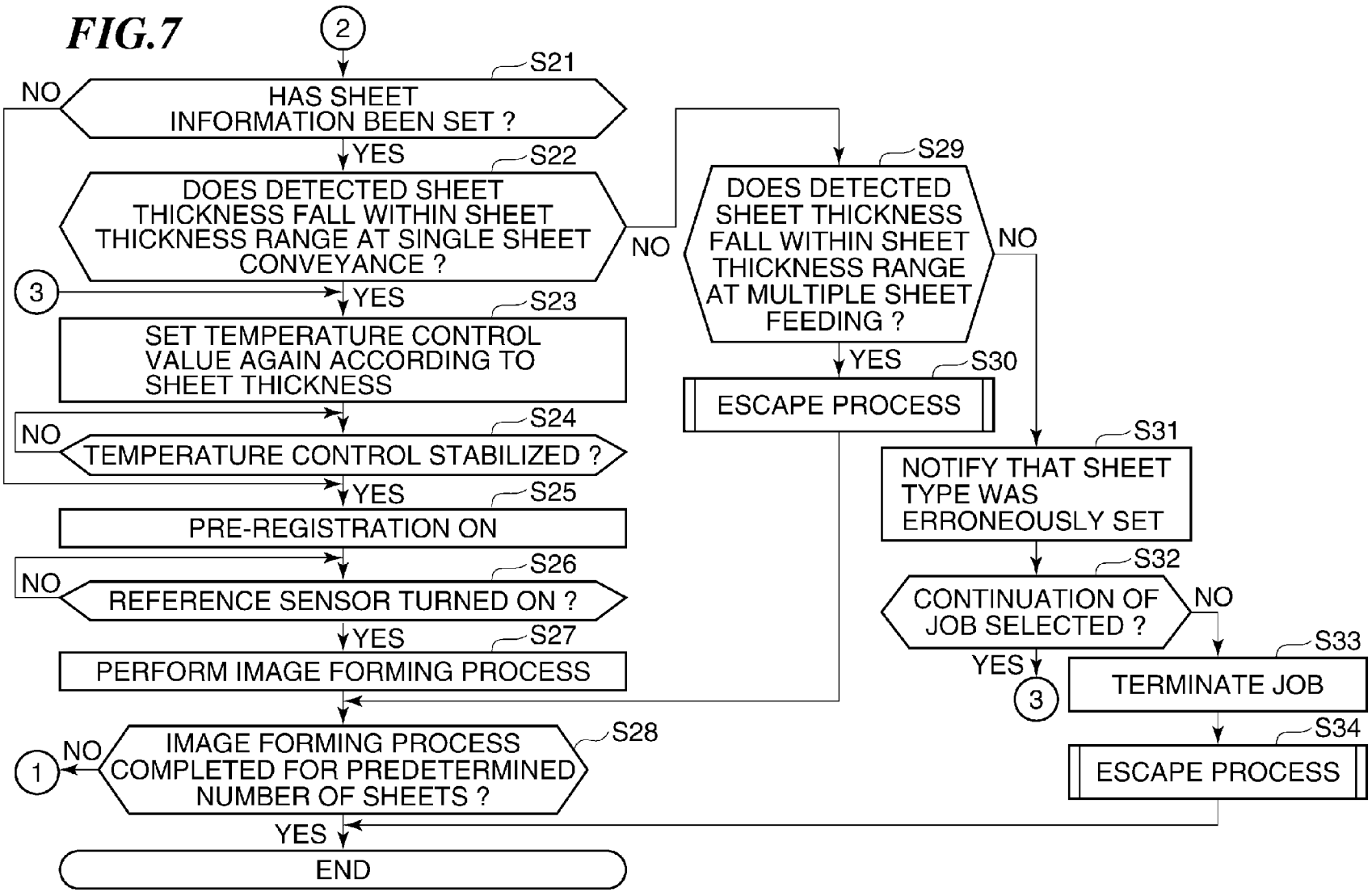
FIG. 7 is a flowchart, that follows the flowchart shown in FIG. 6, showing the remaining part of the procedures of the image forming control process.

FIGS. 6 and 7 show in flowchart the procedures of an image forming control process performed by the CPU 403 of the image forming apparatus 300. A program for the control process is stored in the ROM 601 of the image forming apparatus 300 and executed by the CPU 403.

At power-on, the CPU 403 performs initial adjustment control, e.g., to check for apparatus error, alarm status, and amount of residual sheets and to control fan air volume in the sheet feed unit, fixing temperature pre-adjustment, and image adjustment. Subsequently, the CPU 403 shifts the image forming apparatus 300 to a standby state.

The CPU 403 waits for reception of a job request from the operation unit 302 or from the controller 404 via the network (step S11). A job request includes job information (sheet information, image information, and post-processing information), which is manually set by the user. In the following, sheet conveyance will mainly be described in detail.

When receiving a job request, the CPU 403 determines based on job information acquired from the job request whether sheets should be fed from the sheet feed unit 313 of the image forming apparatus 300 or from the sheet feed unit 311 or 312 of the sheet feeding apparatus 301 (step S12). When determining that sheets should be fed from the sheet feed unit 313, the CPU 403 outputs, via the ASIC 406, control signals for fan control and conveyance motor control to the conveyance control unit 409 to cause the sheet feeding conveyance unit 316*c* to convey sheets one by one from the storage container 3313 (step S13).

Then, the CPU 403 causes the sheet thickness detection device 501 disposed downstream of the sheet feeding conveyance unit 316*c* to perform a sheet thickness detection process to detect a thickness of a sheet being conveyed (step S14). The sheet thickness detection process will be described later. Next, the CPU 403 receives an output from the sheet thickness detection device 501, and converts the received output into a sheet thickness (step S15). Subsequently, the CPU 403 performs control to cause the sheet having passed through the sheet thickness detection device 501 to temporarily stop and wait at a pre-registration position where the pre-registration sensor 503 is disposed (step S20).

When determining in step S12 that sheets should be fed from the sheet feed unit 311 or 312 of the sheet feeding apparatus 301, the CPU 403 notifies a sheet feed request to the CPU 411 of the sheet feeding apparatus 301 via the bus 405 (step S16). In response to the sheet feed request, the CPU 411 of the sheet feeding apparatus 301 controls sheet feeding as previously described with reference to FIG. 5.

The CPU 403 acquires via the bus 405 from the CPU 411 a result of the sheet thickness detection by the sheet thickness detection device 500 about a sheet being conveyed under the control of the CPU 411 (step S17), and waits for reception from the CPU 411 of a notification that preparation for sheet delivery to the image forming apparatus 300 has been completed (step S18). When receiving the notification, the CPU 403 transmits a delivery timing signal 440 to make a request for sheet delivery (step S19), whereby the image forming apparatus 300 receives the sheet from the sheet feeding apparatus 301. In step S20, the CPU 403 causes the sheet to stop and wait at the pre-registration position.

While the sheet is in a waiting state at the pre-registration position, it is determined whether a result of the sheet thickness detection performed by the sheet thickness detection device 500 or 501 is valid. To this end, the CPU 403 determines whether sheet setting information about the sheet fed from the sheet feed unit 311, 312, or 313 is valid (step S21). If sheet information has not been set by the user through the operation unit 302 or through the host PC when the image forming system is in the standby state, the CPU 403 determines that the result of the sheet thickness detection is invalid, and then proceeds to step S25.

On the other hand, when determining in step S21 that the sheet setting information is valid, the CPU 403 converts sheet basis weight information manually set by the user into sheet thickness information S1L, S1H based on the set basis weight-to-sheet thickness conversion table (see FIG. 3) stored in the ROM 601 of the image forming apparatus 300 or in the ROM 701 of the sheet feeding apparatus 301, and determines whether the sheet thickness detected by the sheet thickness detection device 500 or 501 falls within a sheet thickness range from S1L to S1H at the time of single sheet conveyance (step S22).

Figure 8:
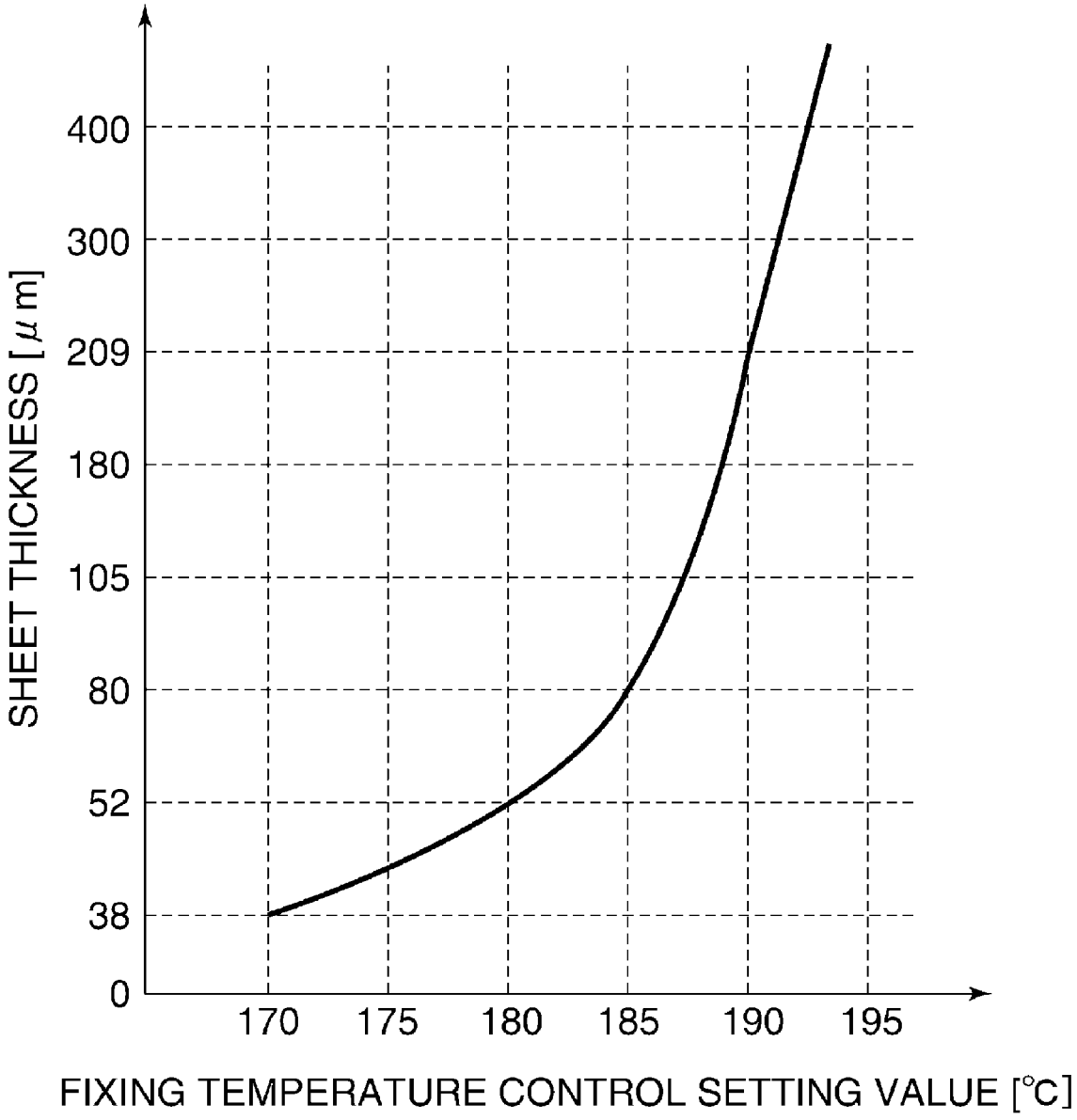
FIG. 8 is a graph showing a relation between setting value of fixing temperature and sheet thickness.

If the answer to step S22 is YES, in order to again set (or reset) a fixing temperature corresponding to the sheet thickness information, the CPU 403 decides a control value based on a sheet thickness-to-fixing temperature control value conversion table shown in FIG. 8 and outputs the decided control value to the fixing control unit 408 via the ASIC 406. The fixing control unit 408 performs heater control according to the control value.

The CPU 403 waits for the heater temperature being stabilized at the reset value (step S24). If control to ensure a standby temperature was performed in the standby state and if a sheet basis weight was set by the user when the job request was made, a temperature adjustment has already been performed to ensure a heater temperature suited to a sheet thickness corresponding to the set sheet basis weight. In that case, a time required for the heater temperature to be stabilized is short and the reset temperature control value is reached in an extremely short time. However, a type of the sheet being conveyed is different from a sheet type specified in sheet information, it takes a long time for the reset fixing temperature control value to be reached.

After the fixing temperature being controlled is stabilized, the CPU 403 outputs the control value to the conveyance control unit 409 via the ASIC 406 (pre-registration ON) in order to start conveyance of the sheet waiting at the pre-registration position (step S25). After the pre-registration is ON, the CPU 403 waits for the reference sensor 305 being turned ON (step S26). Triggered by the image reference sensor 305 being turned ON, the CPU 403 causes via the ASICs 400 and 406 the image formation control unit 407 to execute an image formation control process, whereby an image forming process is performed (step S27). Since the image forming process is well known, a description thereof is omitted.

Next, the CPU 403 determines whether the image forming process has been completed for the predetermined number of sheets specified in the job request (step S28). If the answer to step S28 is NO, the flow returns to step S12. On the other hand, if the answer to step S28 is YES, the CPU 403 shifts the image forming apparatus 300 to the standby state (waiting state), whereupon the present process is completed. Sheets each formed with an image are discharged from the image forming apparatus 300 to the post-processing apparatus 304 where the sheets are subjected to post-processing such as stapling, folding, and punching as specified by the user. Subsequently, the sheets are discharged to the sheet discharge tray 370.

When determining in step S22 that the sheet thickness detected by the sheet thickness detection device 500 or 501 falls outside the sheet thickness range from S1L to S1H at the time of single sheet conveyance, the CPU 403 determines whether the sheet thickness detected by the sheet thickness detection device falls within a sheet thickness range from S2L to S2H at the time of multiple sheet feeding (double sheet conveyance), the range being obtained by converting the sheet basis weight based on the set basis weight-to-sheet thickness conversion table shown in FIG. 3 (step S29).

If the answer to step S29 is YES, the CPU 403 performs an escape process, determining that multiple sheets are fed simultaneously (step S30), and then proceeds to step S28. The details of the escape process will be described later.

On the other hand, when determining in step S29 that the sheet thickness detected by the sheet thickness detection device 500 or 501 falls outside the sheet thickness range at the time of double sheet conveyance (denoted by symbols S2L and S2H), the CPU 403 determines that a type of the sheet being conveyed is different from a sheet type set by the user. Then, the CPU 403 causes the operation unit 302 to display on its screen that the sheet type was erroneously set, thereby notifying the user to that effect (step S31). On the notification screen, an inquiry is made about whether the job should be continued without change.

Next, the CPU 403 determines whether continuation of the job is selected (step S32). If continuation of the job is selected, the flow proceeds to step S23 in which the fixing temperature control value is set again according to the sheet thickness detected by the sheet thickness detection device 500 or 501. In this case, since there is a large difference between the detected sheet thickness and a sheet thickness corresponding to the sheet type set by the user, a time required for the temperature control to be stabilized becomes longer than usual.

On the other hand, when determining in step S32 that continuation of the job is not selected, the CPU 403 terminates the job (step S33), and performs an escape process to forcibly discharge the remaining sheets in conveyance units of the image forming apparatus 300 and the sheet feeding apparatus 301 (step S34). Subsequently, the CPU 403 shifts the image forming apparatus 300 to the standby state (waiting state), and completes the present process.

Figure 9:
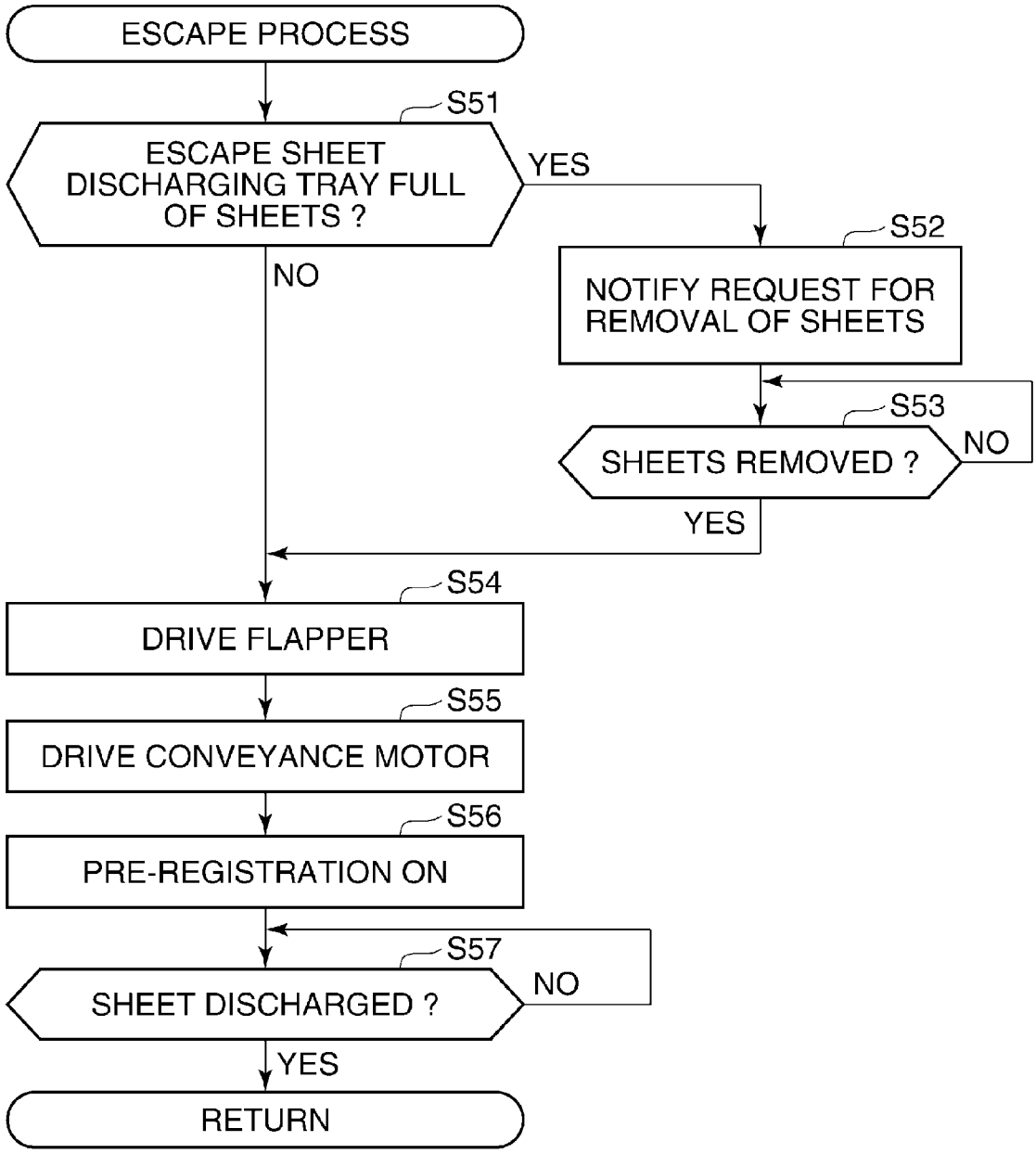
FIG. 9 is a flowchart showing procedures of an escape process performed in the image forming control process in FIGS. 6 and 7.

FIG. 9 shows in flowchart procedures of the escape process performed in steps S30 and S34 of the image forming control process shown in FIGS. 6 and 7. In the escape process, the CPU 403 determines whether the escape sheet discharging tray 101 is full of sheets based on the status of the escape sheet-full detection device 102 (step S51).

If the escape sheet discharging tray 101 is full of sheets, the CPU 411 of the sheet feeding apparatus 301 notifies to that effect to the CPU 403 of the image forming apparatus 300 via the bus 405.

In response to the notification, the CPU 403 causes the operation unit 302 to display a notification to ask the user to remove the sheets on the escape sheet discharging tray 101

(step S52), and waits for the sheets being removed (step S53). When determining in step S53 that the sheets are removed or when determining in step S51 that the escape sheet discharging tray 101 is not full of sheets, the CPU 403 causes the conveyance control unit 409 to drive the flapper 310 so that a sheet can be discharged to the escape sheet discharging tray 101 (step S54).

Next, the CPU 403 causes the conveyance control unit 409 to drive a conveyance motor (not shown) disposed in a conveyance path that extends to the escape sheet discharging tray 101 (step S55), and restarts conveyance of a sheet waiting at the pre-registration position (pre-registration ON) (step S56), whereby the sheet is conveyed via the flapper 310 to the escape sheet discharging tray 101. An escape sheet discharge sensor (not shown) is provided at an exit, which is located at immediately short of the escape sheet discharging tray 101. The CPU 403 detects an output of the sheet discharge sensor via the conveyance control unit 409 to thereby confirm whether the sheet is discharged, and waits for the sheet being discharged (step S57). When the sheet is discharged, the flow returns to the image formation control process shown in FIGS. 6 and 7.

Figure 10:
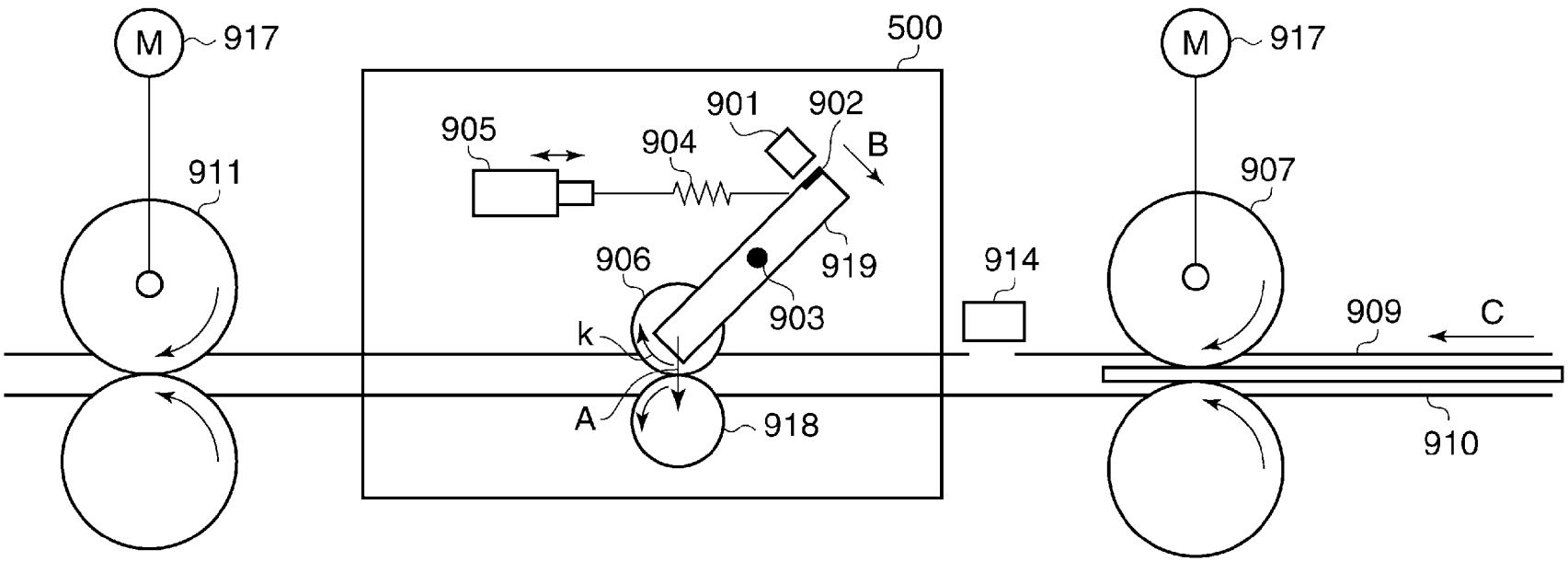
FIG. 10 is a view showing a mechanical construction of the sheet thickness detection device and peripheral elements thereof.

FIG. 10 shows a mechanical construction of the sheet thickness detection device 500 and peripheral elements thereof. Since the sheet thickness detection device 501 has the same basic construction as the device 500 except for path structure, a description thereof will be omitted.

Referring to FIG. 10, a conveyance path 910 is formed by metal sheets disposed to face each other and configured to convey a sheet 900 in a direction shown by arrow C. A conveyance roller pair 907 is disposed upstream of the sheet thickness detection device 500 and driven by a conveyance motor 916. A conveyance roller pair 911 is disposed downstream of the sheet thickness detection device 500 and driven by a conveyance motor 917. The conveyance roller pairs 907, 911 convey the sheet 909. A conveyance sensor 914 is a reflective optical sensor and arranged to detect a position of the sheet 909 in the conveyance path 910.

The following is a description on the construction of the sheet thickness detection device 500. A fixed roller 918 is fixed in the conveyance path 910 and applied with a nip pressure by a detection roller 906 acting in a direction shown by arrow A. The fixed roller 918 and the detection roller 906 are driven rollers, which are arranged to permit a sheet to be conveyed therebetween and which are disposed for contact with each other.

The detection roller 906 has a roller shaft connected to one end of a swing member 919 and is rotated in a direction shown by arrow k as the sheet 909 is conveyed. The swing member 919 is pivotable around a pivot shaft (fulcrum) 903 in a direction shown by arrow B when the detection roller 906 is in contact with the sheet 909 and pivoted in the direction of sheet thickness. The swing member 919 is disposed to form an angle of 45 degrees with respect to the sheet conveyance direction C in an initial state where sheet conveyance is not performed. A magnetic body 902 is attached to another end of the swing member 919, and a magnetic sensor 901 is disposed to face the magnetic body 902 and to be apart from the swing member 919 by a predetermined distance. In this embodiment, a hall element is used as the magnetic sensor 901 and the distance between the magnetic sensor 901 and the swing member 919 is set to be equal to 1.0 mm. An elastic member 904 that pulls the swing member 919 in the sheet conveyance direction C is connected at its one end to the end of the swing member 919 on the side close to the magnetic sensor 901. A pressure changeover solenoid 905 is disposed on an imaginary extension line extending from the elastic member 904 and connected to another end of the elastic member 904.

Figure 11:
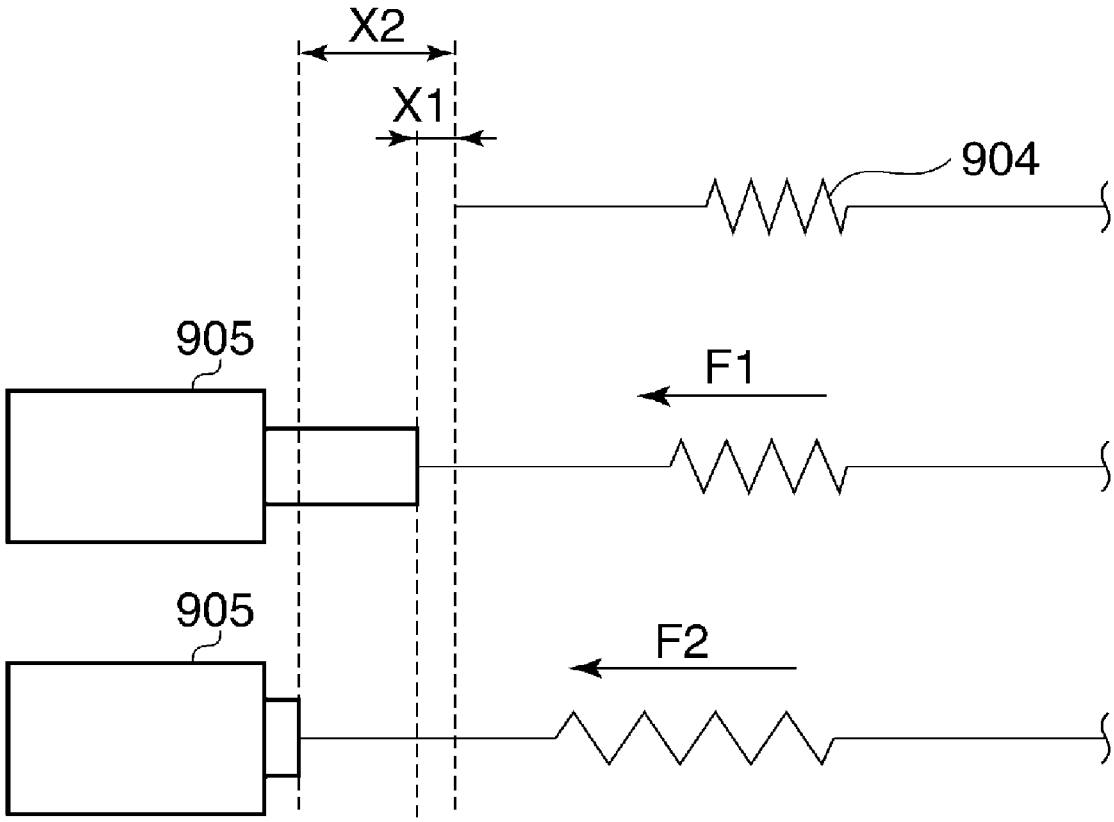
FIG. 11 is a view showing a relation between tension of an elastic member and amount of operation of a pressure changeover solenoid in the sheet thickness detection device.

FIG. 11 shows a relation between tension of the elastic member 904 and amount of operation of the pressure changeover solenoid 905. When the pressure changeover solenoid 905 is in a non-driven state, the elastic member 904 is extended from its natural length by a length of X1 and has a tension of F1 which is represented by the following formula (1) where symbol K represents a spring constant.

$$F1=KX1 \quad (1)$$

On the other hand, when the pressure changeover solenoid 905 is in a driven state, a movable part of the solenoid 905 is retreated away from the elastic member 904, so that the elastic member 894 is extended from the natural length by a length of X2 and has a tension of F2 represented by the following formula (2).

$$F2=KX2 \quad (2)$$

In this embodiment, the lengths X1, X2 are set as shown in the following formula (3) such that the tension F2 is four times as large as the tension F1.

$$4X1=X2 \quad (3)$$

In the sheet thickness detection device 500 constructed as described above, the detection roller 906 connected to one end of the swing member 919 swings according to the thickness of the sheet 909, and the swing member 919 is pivoted around the pivot shaft 903. As a result, the distance between the magnetic sensor 901 and the magnetic body 902 increases, so that an amount of magnetic flux around the magnetic body 902, which is detected by the magnetic sensor 901, decreases in proportion to the increasing distance between the magnetic sensor 901 and the magnetic body 902. By detecting a change in voltage which is output from the magnetic sensor 901 according to the change in the amount of magnetic flux, the thickness of the sheet 909 can be detected. It should be noted that the magnetic sensor 901 and the magnetic body 902 are an example of a displacement amount detection unit of this invention.

Figure 12:
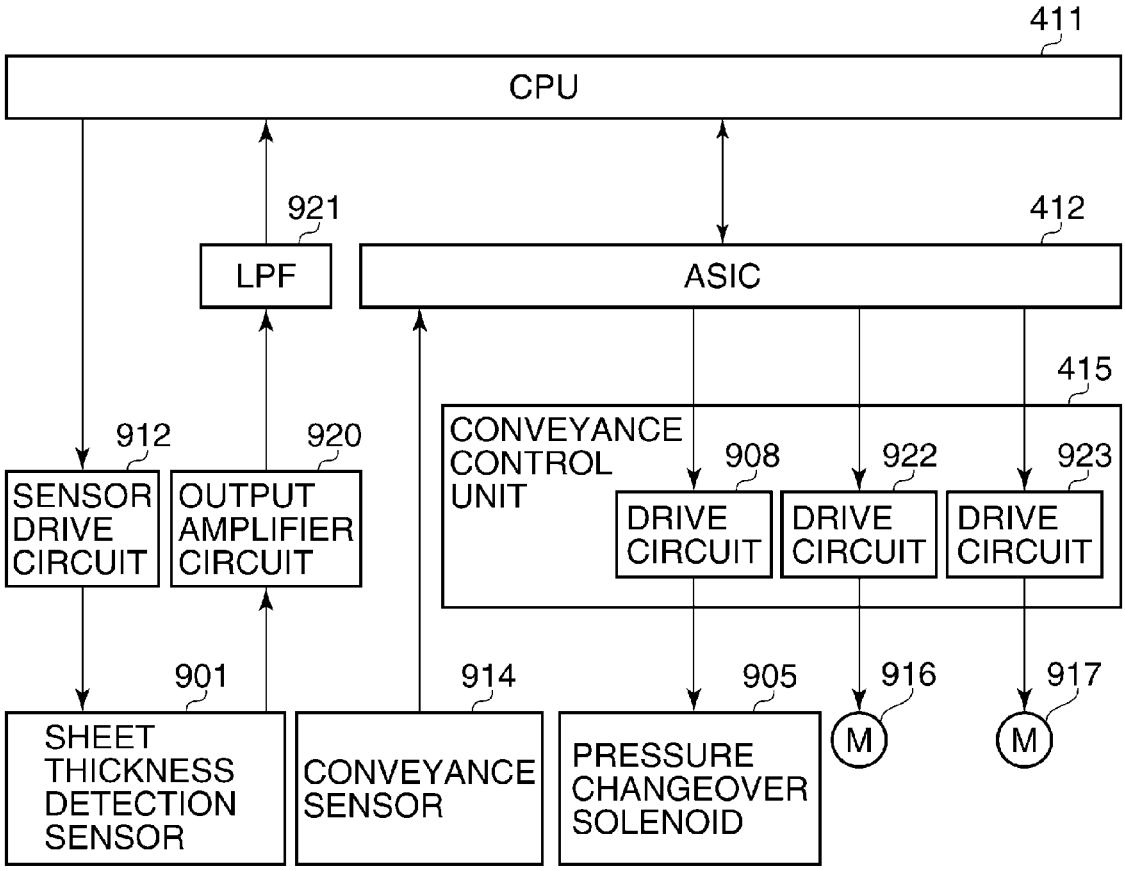
FIG. 12 is a block diagram showing an electrical construction of the sheet thickness detection device and the sheet feeding apparatus.

FIG. 12 shows in block diagram an electrical construction of the sheet thickness detection device 500 and the sheet feeding apparatus 301. Since the sheet thickness detection device 501 is substantially the same in electrical construction as the detection device 500, a description thereof will be omitted.

The upstream conveyance motor 916 provided in the sheet conveyance path is driven by a drive circuit 922 in the conveyance control unit 415. The drive circuit 922 is supplied with a control signal from the CPU 411 via the ASIC 412. The downstream conveyance motor 917 is driven by a drive circuit 923. The pressure changeover solenoid 905 is driven by a drive circuit 908 in the conveyance control unit 415. The drive circuit 908 is supplied with a control signal from the CPU 411 via the ASIC 412. A movable part of the pressure changeover solenoid 905 is retreated when the solenoid 905 is driven, and is returned when the solenoid is not driven. A signal from the conveyance sensor 914 is input into the ASIC 412, so that the status of the sensor 914 is monitored by the CPU 411.

The magnetic sensor 901 as a sheet thickness detection sensor is driven at constant current by a sensor drive circuit 912. Since an output of the magnetic sensor 901 is minute, the sensor output is amplified by an output amplifier circuit 920 and then supplied to an AD converter of the CPU 411 via an LPF 921 that improves SN ratio.

Figure 13:
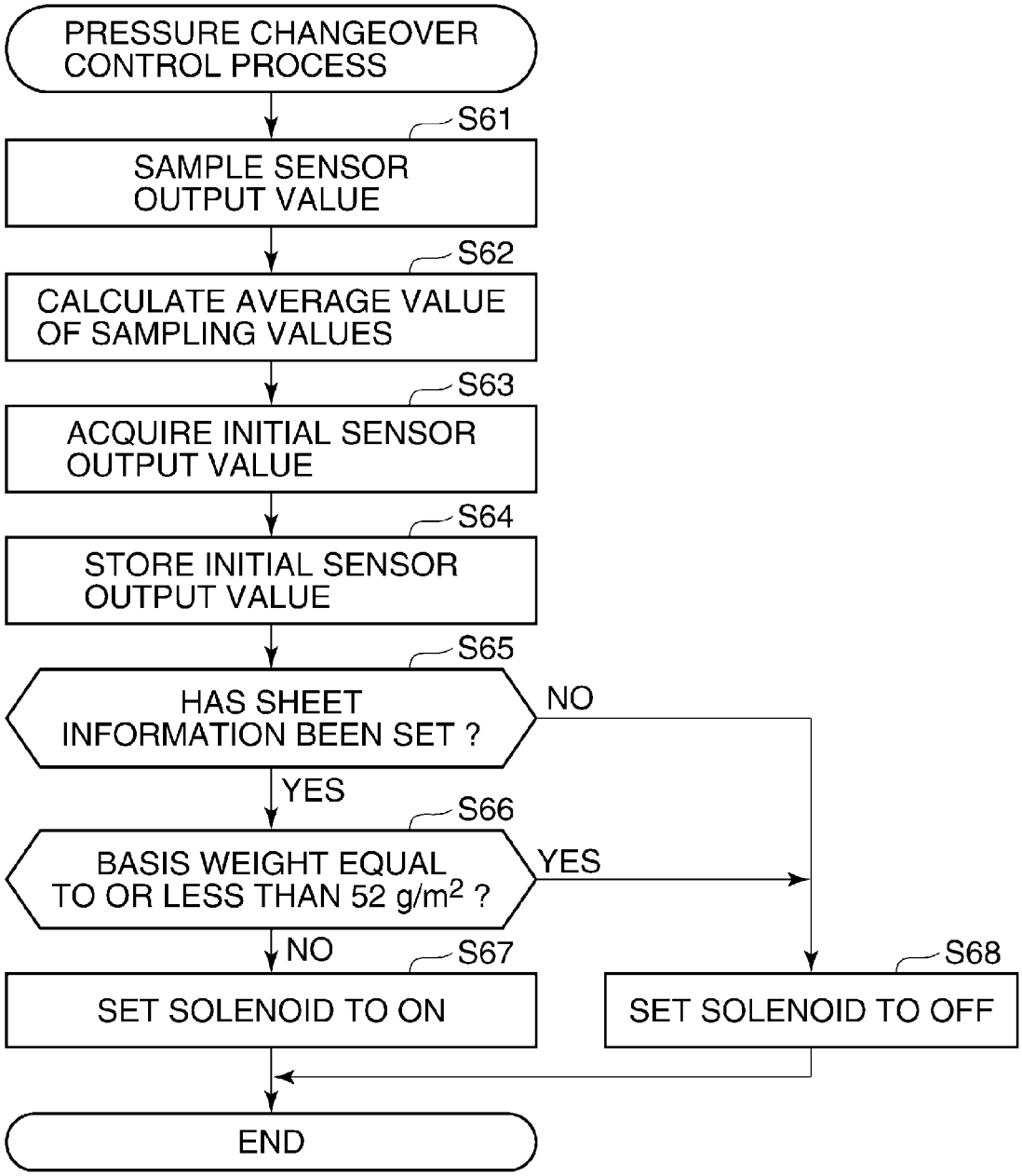
FIG. 13 is a flowchart showing procedures of a pressure changeover control process performed by the sheet thickness detection device.

FIG. 13 shows in flowchart the procedures of a pressure changeover control process performed by the sheet thickness detection device 500. A control program therefor is stored in the ROM 701 and executed by the CPU 411. The pressure changeover control process is performed as part of the initial adjustment control executed by the image forming system at power-on, and is started at an arbitrary timing in the initial adjustment control executed by the sheet feeding apparatus 301. It should be noted that the pressure changeover control process is also performed by the sheet thickness detection device 501 of the image forming apparatus 300.

The CPU 411 causes the AD converter to sample five times an output value from the magnetic sensor 901 of the sheet thickness detection device 500 at intervals of 4 msec in a state where the sheet 909 is not conveyed (step S61).

The CPU 411 discards the maximum and minimum sampling values among the sampling values acquired five times, and computes an average value of the remaining three sampling values (step S62). The CPU 411 acquires the average value as an initial value of sensor output (step S63), and stores it into a predetermined address region of the RAM 702 (step S64). The initial sensor value is used until it is subsequently updated in the initial adjustment control by the sheet feeding apparatus 301.

Next, the CPU 411 determines whether information (size, basis weight, surface property) about sheets stored in the sheet feed units 311, 312 has been set by the user through the operation unit 302 or through the external host PC (step S65), and if the answer to step S65 is YES, determines whether a sheet basis weight specified in the sheet information is equal to or less than, e.g., 52 g/m$^2$ (step S66). If the sheet basis weight is larger than 52 g/m$^2$, the CPU 411 sets the pressure changeover solenoid 905 to ON to obtain a strong nip pressure between the detection roller 906 and the fixed roller 918, and stores the solenoid ON setting into a predetermined address region of the RAM 702 on a per sheet feed unit basis (step S67), whereupon the present process is completed. On the other hand, when determining in step S66 that the sheet basis weight is equal to or less than 52 g/m$^2$, the CPU 411 sets the pressure changeover solenoid 905 to OFF to obtain a weak nip pressure and stores the solenoid OFF setting into the predetermined address region of the RAM 702 on a per sheet feed unit basis (step S68), whereupon the present process is completed.

When determining in step S65 that sheet information has not been set by the user, the CPU 411 sets the pressure changeover solenoid 905 to OFF to forcibly obtain a weak nip pressure for each of the sheet feed units, and stores information representing absence of sheet information setting in a predetermined address region of the RAM 702 (step S68), whereupon the present process is completed.

Figure 14:
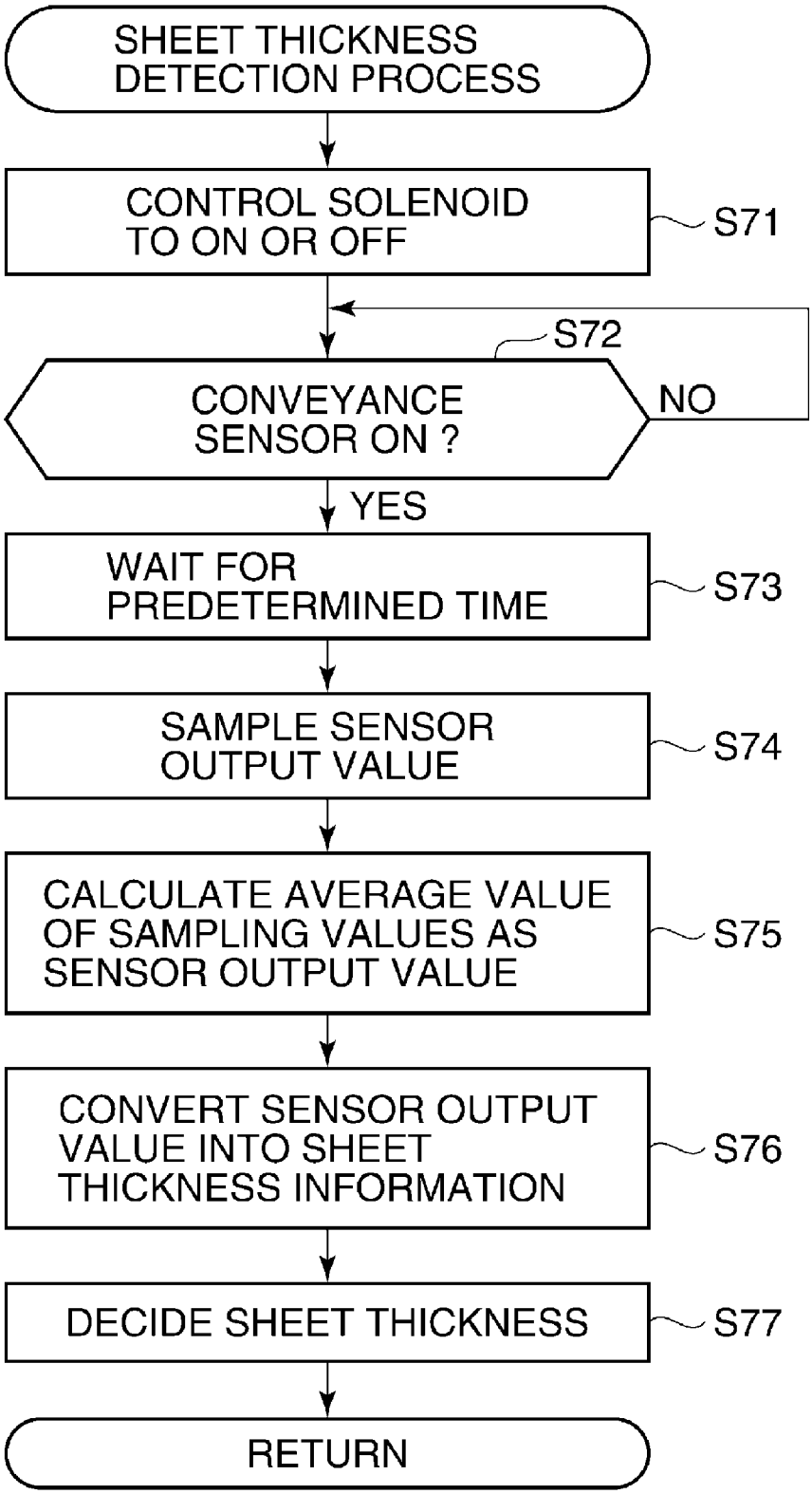
FIG. 14 is a flowchart showing procedures of a sheet thickness detection process executed by the sheet thickness detection device in the sheet conveyance control process of FIG. 5 and in the image forming control process of FIGS. 6 and 7.

FIG. 14 shows in flowchart the procedures of the sheet thickness detection process executed by the sheet thickness detection device in step S3 of the sheet conveyance control process of FIG. 5 (executed by the sheet feeding apparatus 301) and in step S14 of the image forming control process of FIGS. 6 and 7 (executed by the image forming apparatus 300).

The CPU 411 controls the pressure changeover solenoid 905 to ON or OFF, while referring to the RAM 702, to obtain the nip pressure decided in the pressure changeover control process shown in FIG. 13 (step S71). At that time, a control signal is output from the ASIC 412 to the drive circuit 908 in the form of a PWM signal, thereby preventing a temperature rise which would be caused if the pressure changeover solenoid 905 is continuously kept ON.

Next, the CPU 411 monitors via the ASIC 412 the output of the conveyance sensor 914 disposed immediately upstream of the sheet thickness detection device 500, and waits for the conveyance sensor 914 being turned ON (step S72). When the conveyance sensor 914 is turned ON, i.e., when it is detected that the sheet 909 has passed through the sensor 914, the CPU 411 waits for a predetermined time (step S73). In other words, the CPU 411 performs control such that an output value of the magnetic sensor 901 is not used as a sensor value until vibration of the swing member 919 produced by a shock caused by the sheet 909 running to under the detection roller 906 is settled.

Figure 15:
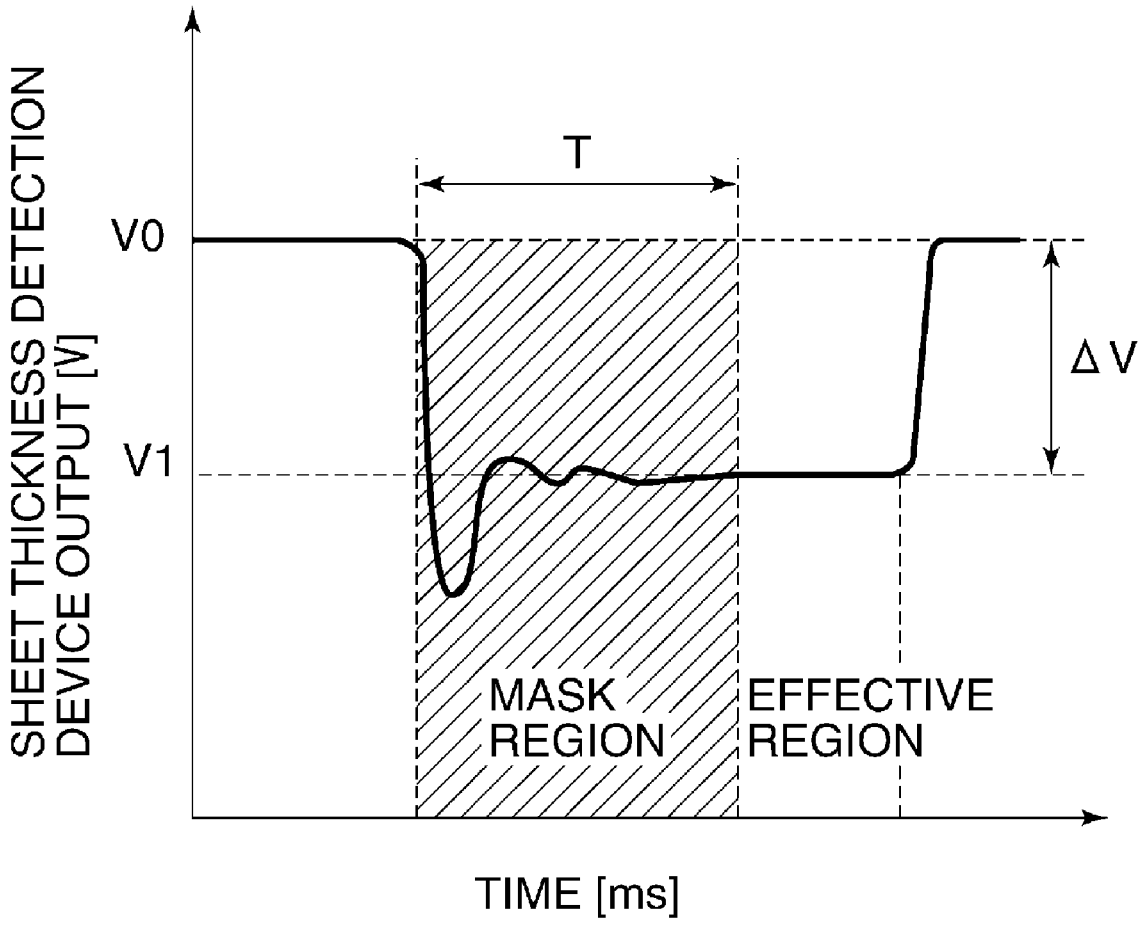
FIG. 15 is a graph showing a time-based change in waveform of output from the sheet thickness detection device.

FIG. 15 shows in graph a time-dependent change in waveform of the output from the sheet thickness detection device 500. In this embodiment, an unstable time (shown by symbol T in FIG. 15) due to a shock caused by a sheet running to under the detection roller lasts for 120 msec at the maximum. After lapse of a predetermined time, which is equal to or longer than the unstable time T, from when the sheet 909 ran to under the detection roller 906, the CPU 411 causes the AD converter to sample five times an output value from the magnetic sensor 901 at intervals of 4 msec (step S74).

The CPU 411 discards the maximum and minimum sampling values among the sampling values acquired in step S74, and computes an average value of the remaining three sampling values (step S75). The CPU 411 uses the average value as the output value of the sheet thickness detection sensor.

While referring to the sheet thickness detection device output-to-sheet thickness conversion table (see FIG. 4) stored in the ROM 701, the CPU 411 converts the output value of the sheet thickness detection sensor into sheet thickness information (step S76). Then, the CPU 411 decides the sheet thickness information as a detected sheet thickness value, and stores it into a predetermined address region of the RAM 702, which is provided on a per sheet feed unit basis (step S77).

The sheet thickness detection device 500 of the first embodiment is configured that the amount of displacement of the swing member 919 pivoted to follow the sheet thickness is detected by the magnetic sensor 901, which includes the magnetic body 902 attached to the swing member 919 and the hall element disposed to face the magnetic body 902. However, the method for detecting the amount of pivotal motion of the swing member 919 to follow the sheet thickness is not limited to the above arrangement. For example, the amount of displacement of the swing member 919 can be detected by using an optical sensor.

Figure 16:
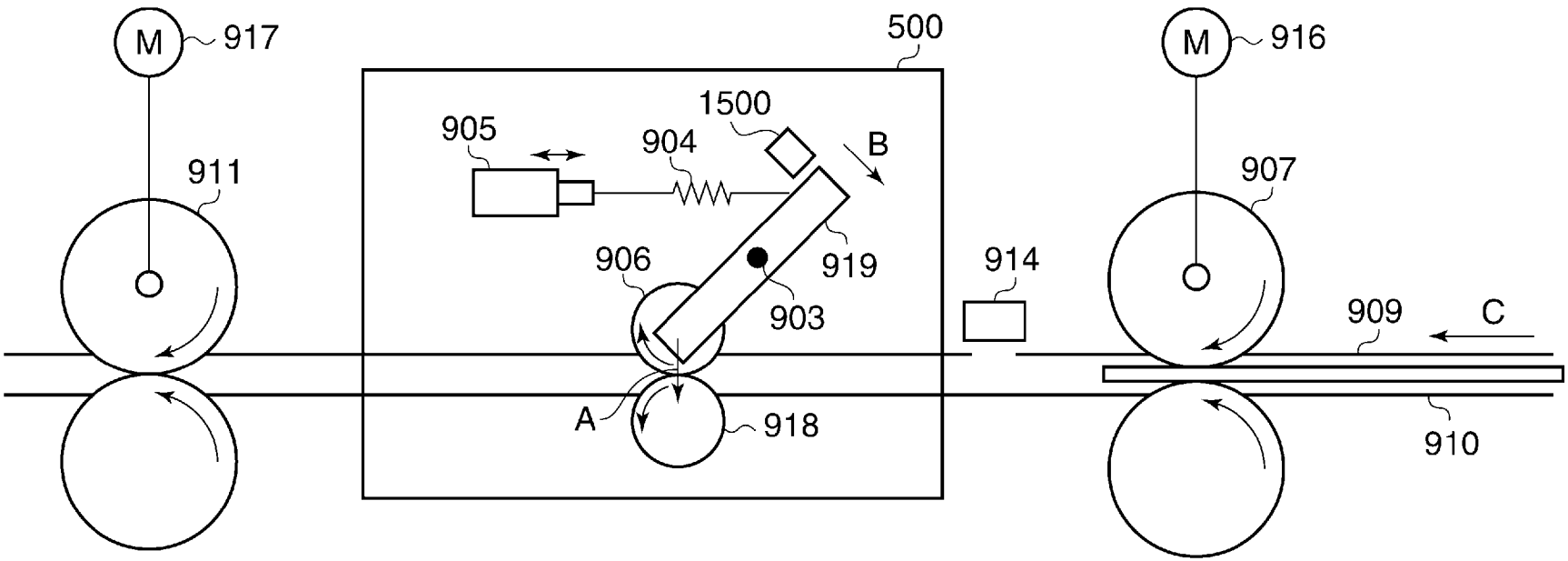
FIG. 16 is a view showing a mechanical construction of the sheet thickness detection device where an optical sensor is used.

FIG. 16 shows a mechanical construction of a sheet thickness detection device in which an optical sensor (denoted by reference numeral 1500) is used. A slit plate (not shown) is attached to an end of the swing member 919 on the side remote from the detection roller 906, and the optical sensor 1500 is disposed to face the slit plate and configured to detect slits formed in the slit plate, thereby detecting an amount of displacement of the swing member 919.

Figure 17:
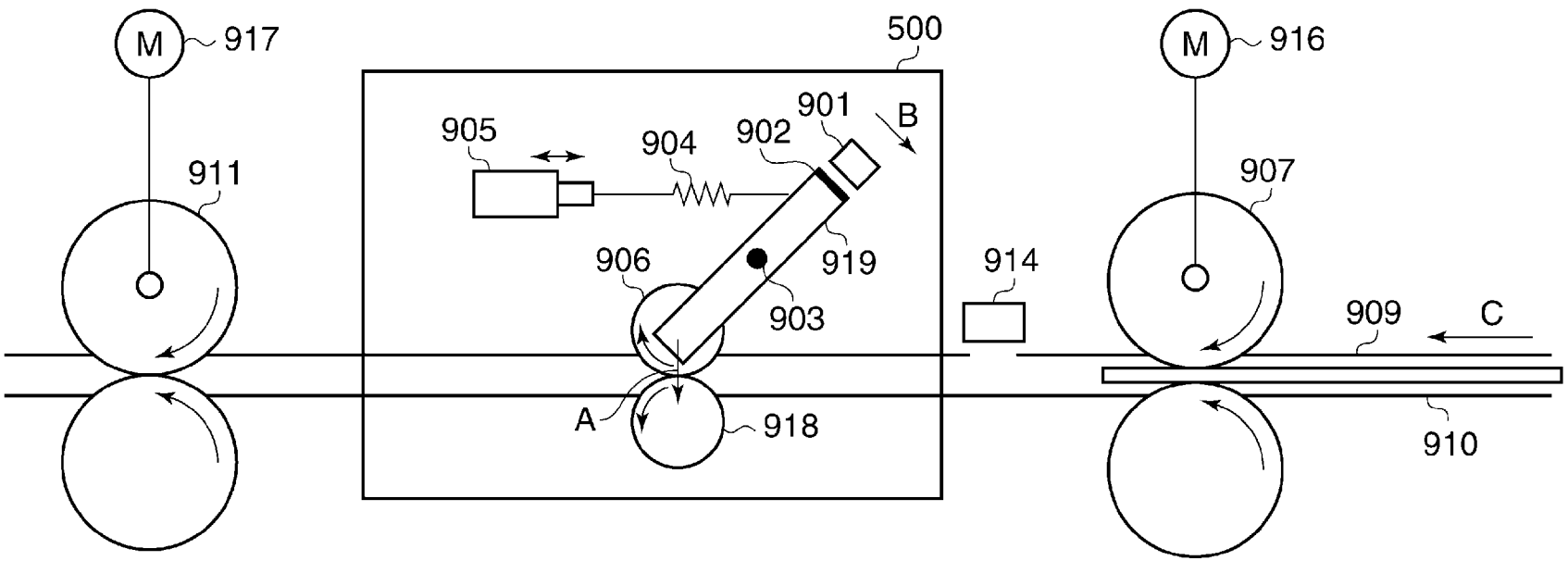
FIG. 17 is a view showing a mechanical construction of the sheet thickness detection device where a positional relation between a magnetic body and a magnetic sensor relative to a swing member is altered from that shown in FIG. 10.

In the sheet thickness sensor, the positional relation of the magnetic body (magnet) 902 and the magnetic sensor 901 relative to the swing member 919 can be altered. FIG. 17 shows a mechanical construction of a sheet thickness detection device in which the positional relation of the magnetic body 902 and the magnetic sensor 901 relative to the swing member 919 is altered from that shown in FIG. 10. The magnetic body 902 is attached to an end surface of the swing member 919 on the side remote from the roller 906, and the magnetic sensor 901 is disposed to face the magnetic body 902. With this positional relation, the amount of pivotal motion (amount of displacement) of the swing member 919 can be detected.

Figure 18:
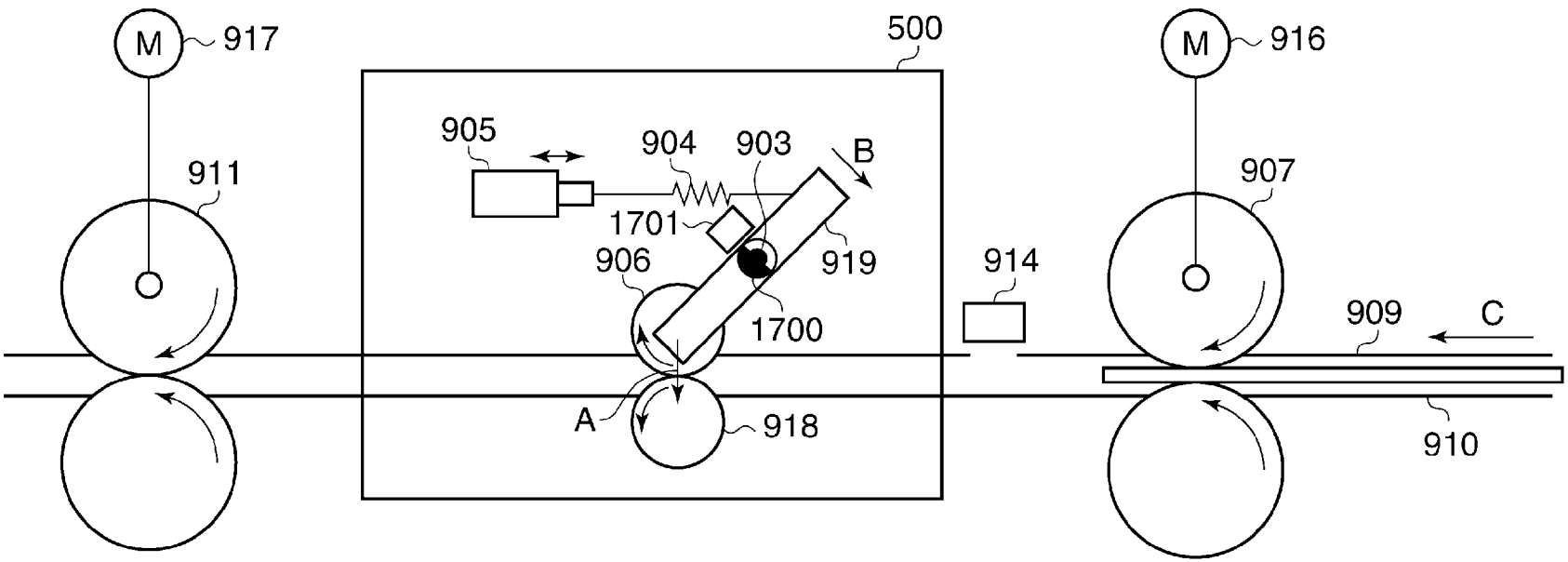
FIG. 18 is a view showing a mechanical construction of the sheet thickness detection device configured to detect a pivot angle of the swing member.

It is also possible to detect an amount of displacement of the swing member 919 corresponding to sheet thickness by detecting a pivot angle (displacement angle) of the swing member 919. FIG. 18 shows a mechanical construction of a sheet thickness detection device configured to detect a pivot angle of the swing member 919. Referring to FIG. 18, a cylindrical magnetic body 1700 is attached to the pivot shaft 903 of the swing member 919. One circumferential half of the magnetic body 1700 is magnetized into N-pole and another circumferential half thereof is magnetized into S-pole, and a magnetic sensor 1701 is disposed to face a boundary between the N pole and the S pole and configured to detect a displacement angle (pivot angle) of the pivot shaft 903.

Figure 19:
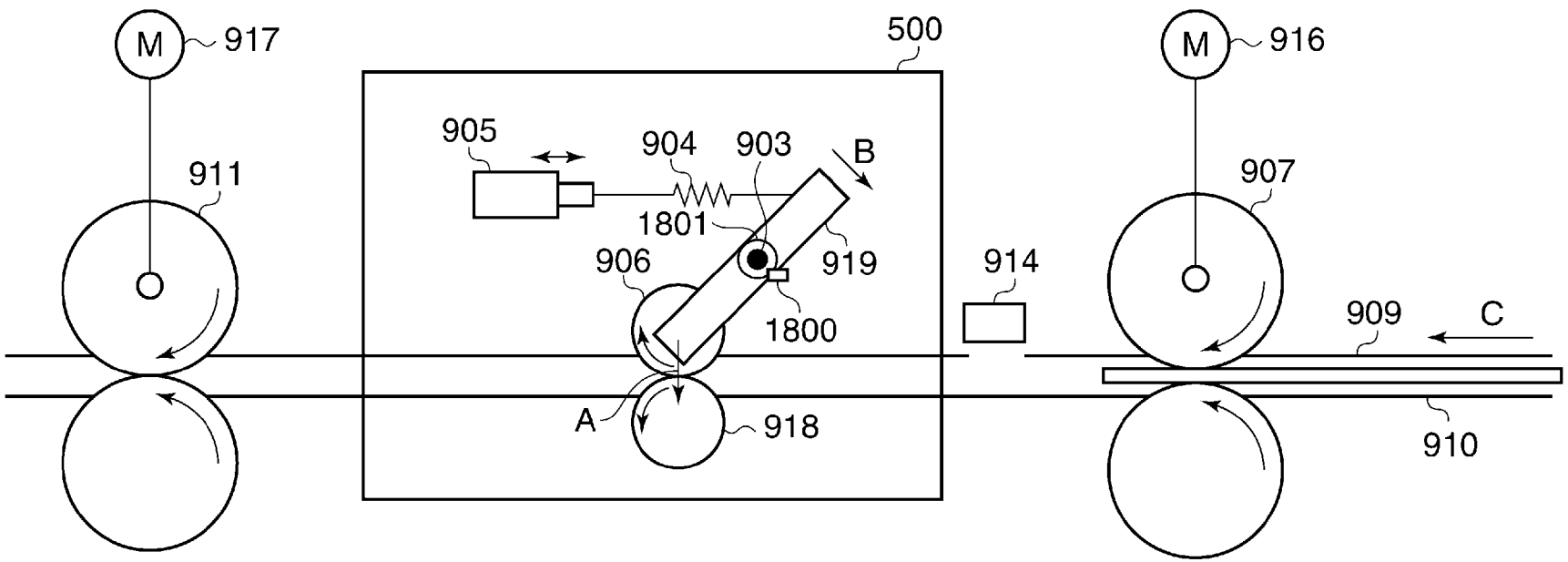
FIG. 19 is a view showing a mechanical construction of the sheet thickness detection device configured to detect a displacement angle by using an optical encoder.

It is further possible to detect an amount of displacement of the swing member 919 by detecting a displacement angle of the pivot shaft 903 of the swing member 919 by using an optical encoder. FIG. 19 shows a mechanical construction of a sheet thickness detection device configured to detect a displacement angle of the pivot shaft 903 by using an optical encoder. Referring to FIG. 19, the optical encoder includes a disk slit 1801 (circular slit plate) formed with radial slits and attached to the pivotal shaft 903 of the swing member 919, and an optical sensor 1800 configured to detect the radial slits of the disk slit 1801.

By using the optical encoder shown in FIG. 19, a displacement angle of the pivot shaft 903 can be detected, from which an amount of pivotal motion of the swing member 919 corresponding to sheet thickness can be detected, thereby capable of detecting a sheet thickness.

According to the sheet thickness detection device of the first embodiment, a pressure applied to a sheet by the driven member is changed based on sheet information such as to become lower with increasing sheet thickness. As a result, it is possible to prevent the quality of sheets from being deteriorated due to sheets being bent, wrinkled, etc., and to shorten a period required to stabilize the output of the sensor for detecting a sheet thickness, thereby ensuring a time required for the detection of sheet thickness. It is therefore possible to accurately detect the thickness of sheets of various types.

Based on the sheet size and the surface property as well as the sheet basis weight (thickness), a pressure applied to a sheet can be controlled. The sheet information can easily be obtained from the user's settings. Since an amount of pivotal motion of the swing member is detected as an amount of displacement of the swing member corresponding to a sheet thickness, it is possible to detect the sheet thickness with ease.

A pressure applied to a sheet can easily be changed by changing the tension of the elastic member by the pressure changeover solenoid. An amount of displacement of the swing member can be detected by various methods such as magnetic detection, optical detection, and shaft displacement angle detection.

Further, it is possible to improve the quality of a sheet product output from the image forming apparatus and to perform proper image process control.

Second Embodiment

Sheet thickness detection devices according to a second embodiment of this invention are each configured by taking into account the fact that there is a fear that an artificial error can be introduced when sheet information (especially, sheet basis weight) used by the sheet thickness detection devices 500, 501 is set by the user through the operation unit 302 or through the host PC (not shown). Since an image forming system of the second embodiment is the same in construction as that of the first embodiment, a description thereof will be omitted.

Figure 20:
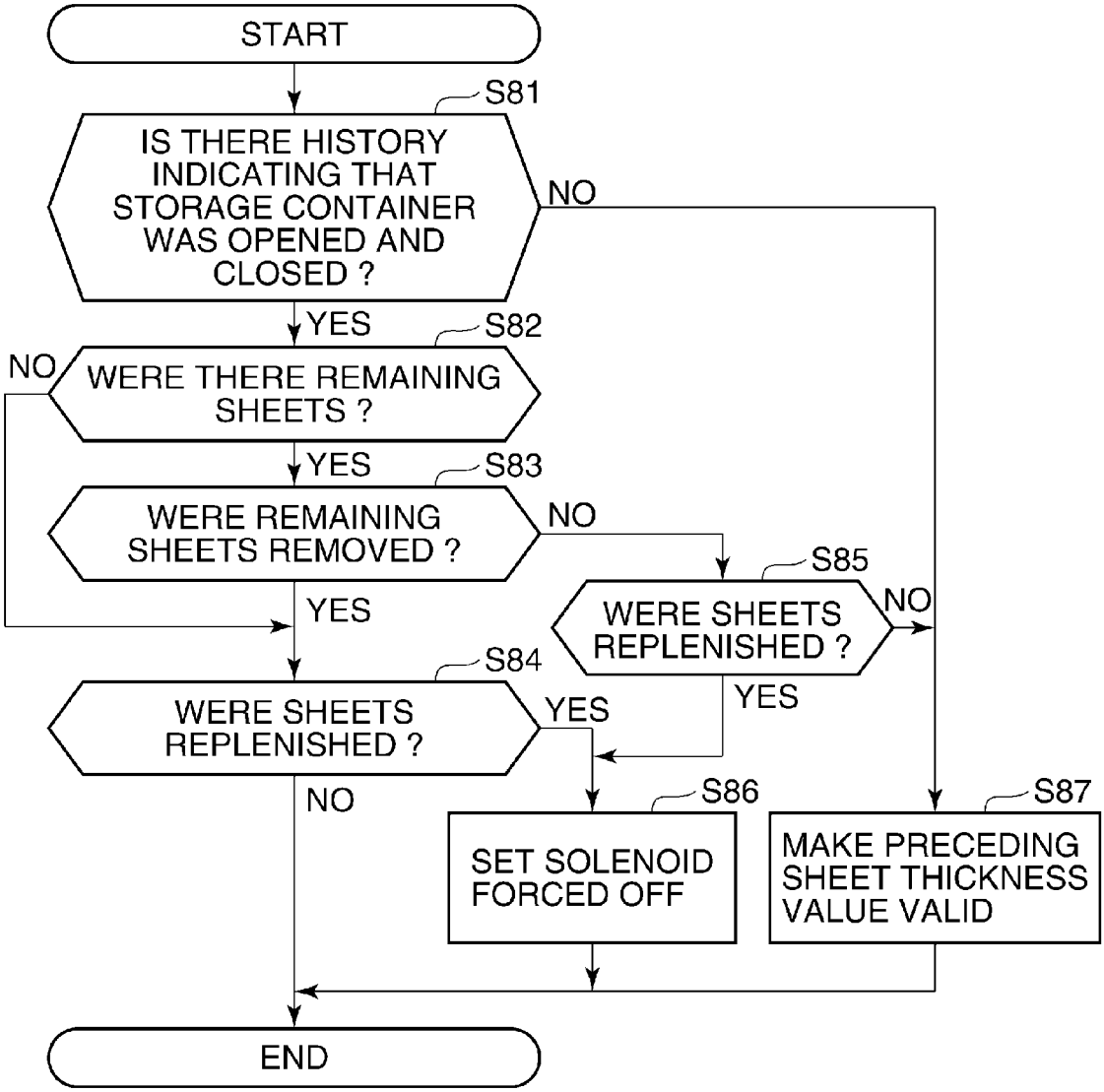
FIG. 20 is a flowchart showing procedures of a process in a second embodiment of this invention for updating a sheet status in sheet feed units of the sheet feeding apparatus having the sheet thickness detection device.

FIG. 20 shows in flowchart the procedures of a process in the second embodiment for updating a sheet status in the sheet feed units of the sheet feeding apparatus having the sheet thickness detection device. A program for the sheet status updating process is stored in the ROM 701 of the sheet feeding apparatus 301 and started by the CPU 411 at an arbitrary time when the sheet feeding apparatus is in the standby state. The following description on the sheet feeding apparatus 301 also applies to the image forming apparatus 300.

When the sheet feeding apparatus 301 is in the standby (waiting) state, the CPU 411 of the apparatus 301 executes the sheet status updating process as an initial control effected at occurrence of a job. First, the CPU 411 confirms whether there is a history indicating that the storage container of the sheet feed unit (an object of the process running at occurrence of a current job) was opened and closed in the standby state after occurrence of a preceding job (step S81).

If there is no history indicating that the storage container was opened and closed, the CPU 411 determines that sheets stored in the storage container have not been changed up to the present time from when the preceding job was executed. Next, the CPU 411 makes a sheet thickness value measured at the preceding job valid and stores the measured value into a predetermined address region of the RAM 702 corresponding to the sheet feed unit (which is the process object), so that the preceding sheet thickness value is preferentially used (step S87), whereupon the present process is completed.

On the other hand, when determining that there is a history indicating that the storage container of the sheet feed unit (process object) was opened and closed in the standby state after occurrence of the preceding job, the CPU 411 determines whether there was one or more remaining sheets in the storage container when the storage container was opened (and thereafter sheets were replenished in some cases) (step S82). If it is determined that there was no remaining sheet in the storage container, the flow proceeds to step S84.

When determining in step S82 that there was one or more remaining sheets in the storage container when the storage container was opened, the CPU 411 confirms whether the remaining sheets were removed from the storage container (step S83). If the remaining sheet were removed, the CPU 411 confirms whether sheets were replenished after the storage container was opened (step S84). If the storage container was closed without sheets being replenished, the CPU 411 determines that there is no sheet in the storage container of the sheet feed unit (which is the process object), and the CPU 411 shifts to a waiting state and completes the present process.

When opening the storage container and then replenishing, into the storage container, sheets which are the same in type as the sheets previously stored in the storage container, the user is not required to set sheet information. On the other hand, when replenishing sheets which are different in type from the previously stored sheets, the user is required to perform an operation to update the setting of sheet information through the operation unit 302. In that case, there is a fear that the user performs an erroneous operation.

In this regard, when determining in step S84 that sheets were replenished, the CPU 411 stores a status (sheet thickness value status) for forcibly making the pressure changeover solenoid 905 OFF, so as to weaken a nip pressure applied by the detection roller 906 to a sheet, into the RAM 702 in association with the sheet feed unit (which is the process object) (step S86), whereby a conveyance failure such as paper jam is prevented from occurring due to a strong nip pressure, even if a sheet type different from a type of sheets replenished to the storage container was erroneously set by the user. Subsequently, the CPU 411 shifts to awaiting state and completes the present process.

When determining in step S83 that the remaining sheets were not removed, the CPU 411 confirms whether sheets were replenished (step S85). When sheets were replenished, it is considered that sheets of the same type as that of the remaining sheets were additionally replenished by the user. Even in that case, however, there is a fear that an erroneous artificial operation was performed. Thus, the flow proceeds to step S86 where the CPU 411 stores a status (sheet thickness value status) for forcibly making the pressure changeover solenoid 905 OFF, so as to weaken a nip pressure applied by the detection roller 906 to a sheet, into the RAM 702 in association with the sheet feed unit (which is the process object).

If it is determined in step S85 that sheets were not replenished, i.e., if the storage container was closed without sheets being replenished, the CPU 411 determines that the sheets stored in the storage container have not been changed up to the present time from when the preceding job was executed. In that case, the flow proceeds to step S87 where the CPU 411 makes the sheet thickness value measured at the preceding job valid and stores the measured value into the predetermined address region of the RAM 702 corresponding to the sheet feed unit (which is the process object), so that the preceding sheet thickness value is preferentially used. Subsequently, the CPU 411 shifts to a waiting state and completes the present process. It should be noted that the processing in steps S84 and S85 is an example of a process of this invention to determine whether a sheet changeover operation was performed.

Figure 21:
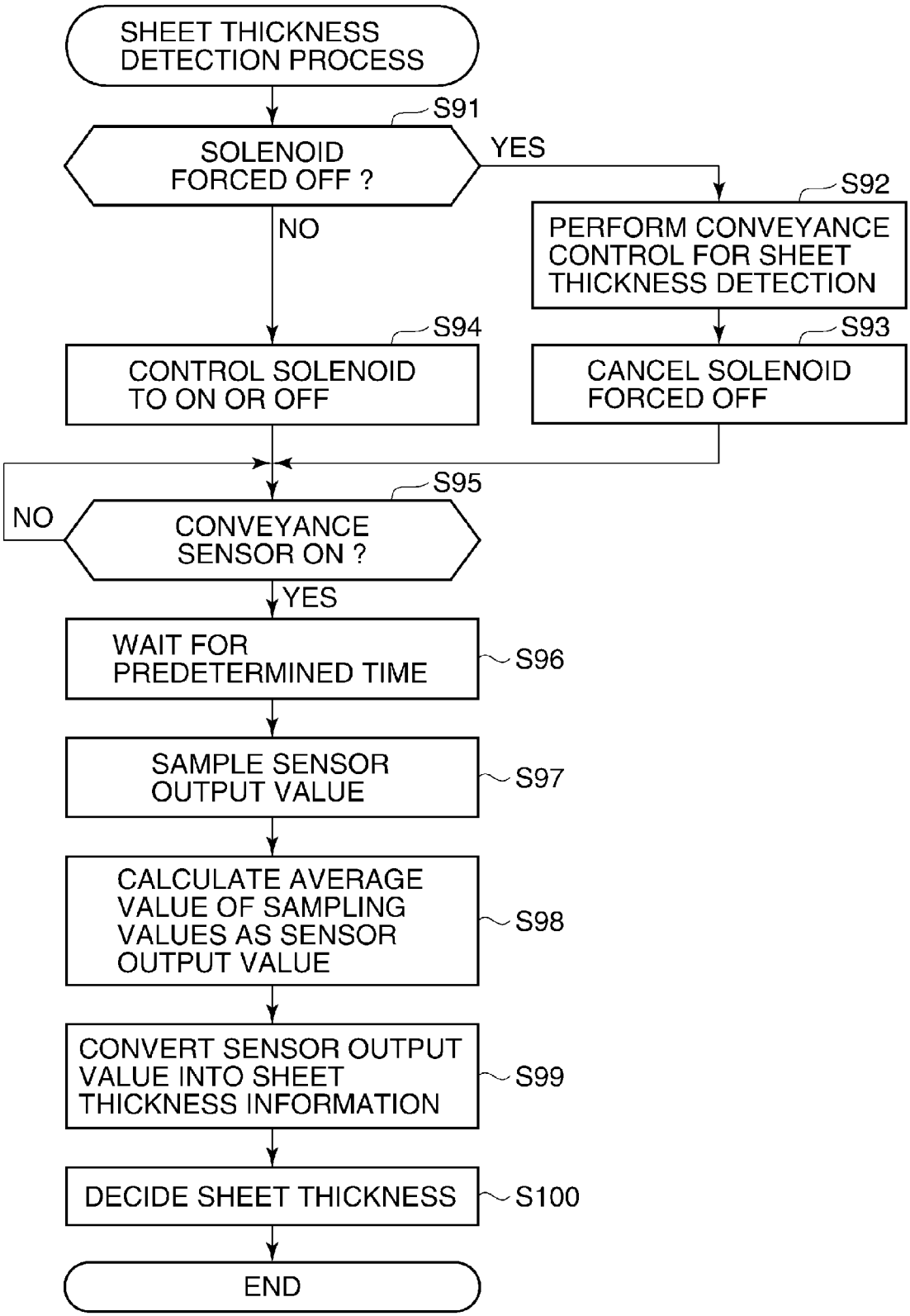
FIG. 21 is a flowchart showing procedures of a sheet thickness detection process.

FIG. 21 shows in flowchart the procedures of a sheet thickness detection process. Since processing performed in steps S94 to S100 in FIG. 21 is the same as the processing performed in steps S71 to S77 of FIG. 14 in the first embodiment, a description thereof will be omitted.

At start of the sheet thickness detection process, the CPU 411 confirms the sheet thickness status (which is previously described referring to FIG. 20) to confirm whether the pressure changeover solenoid 905 has been forcibly set to OFF (whether solenoid forced OFF status has been set) (step S91). When determining that the solenoid forced OFF status has not been set, but the sheet thickness value in the preceding job has been made valid, the flow proceeds to step S94 where the CPU 411 drives the pressure changeover solenoid 905 according to the preceding sheet thickness value.

On the other hand, when determining in step S91 that the solenoid forced OFF status has been set, the CPU 411 performs conveyance control for sheet thickness detection, determining that there is a fear that sheet information has been erroneously set (step S92). In the conveyance control for sheet thickness detection, the sheet feeding apparatus 301 controls to decelerate the conveyance speed in the conveyance units 317, 318. The sheet thickness detection device 500 in the conveyance unit 319 performs sheet thickness detection on sheets conveyed at a speed sufficiently lower than a predetermined conveyance speed for image formation. In this manner, if the solenoid forced OFF status is determined, i.e., if it is determined that a sheet changeover operation was made, the nip pressure applied to the first conveyed sheet is weaken and the conveyance speed for the first conveyed sheet is lowered.

In the image forming apparatus 300, the conveyance path from the sheet feeding conveyance unit 316*c* to the sheet thickness detection device 501 is short in length, and it is therefore difficult to perform deceleration control. Thus, upon lapse of a predetermined period from when a sheet passed through the conveyance sensor 914 of the sheet thickness detection device 501, sheet conveyance is stopped, and the sheet thickness detection is performed by the detection device 501. Subsequently, sheet conveyance is restarted.

As described above, the sheet thickness detection is performed in a state where the sheet conveyance speed is sufficiently lowered or the sheet conveyance is stopped. It is therefore possible to detect the sheet thickness with highly accuracy, even if the nip pressure applied by the detection roller 906 to the sheet is lowered by the solenoid forced OFF, without causing erroneous sensor detection due to a shock caused by the sheet running to the detection roller 906. Further, even if a sheet of a type different from that specified in sheet information is conveyed due to a user's erroneous operation, a conveyance failure does not occur and the sheet thickness detection is not affected.

After performing the conveyance control for sheet thickness detection in step S92, the CPU 411 cancels the solenoid forced OFF status (step S93), whereupon the flow proceeds to step S95.

In steps S95 to S100, the same processing as that in steps S71 to S77 in FIG. 14 is performed as previously mentioned. However, for the secondly conveyed sheet and for the subsequent sheets, the pressure changeover solenoid 905 is driven according to the sheet thickness value decided in step S100. Specifically, in a case that a sheet is supplied from the same sheet feed unit as the sheet feed unit used for sheet conveyance at the preceding sheet thickness detection process, since the solenoid forced OFF status has been canceled, the processing in steps S92 and S93 is not executed and the pressure changeover solenoid 905 is driven in step S94 such as to generate a nip pressure suited to the thickness of sheets stored in the storage container.

With the sheet thickness detection device of the second embodiment, the pressure applied from the driven member to a sheet is changed according to a detected sheet thickness such that the pressure applied to the sheet is lowered with increasing sheet thickness. It is therefore possible to accurately detect the thickness of sheets of various types.

Further, the sheet thickness status of sheets stored in each sheet feed unit is monitored, and the sheet thickness detection is carried out according to the sheet thickness status. It is therefore possible to accurately detect the sheet thickness, even if the sheet type has been erroneously set by the user. It is also possible to prevent a conveyance failure such as paper jam from occurring due to a strong pressure being applied from the swing member to a sheet and prevent a sheet from being bent or wrinkled, whereby the sheet or product is prevented from having a deteriorated quality.

Multiple fed sheets can be escape-processed based on sheet thickness information, whereby inclusion of multiple fed sheets can be prevented. Proper image process control can be executed by, e.g., adjusting the fixing temperature based on the sheet thickness information, whereby the quality of a sheet product output from the image forming apparatus can be improved.

Since the thickness of the first sheet is detected while lowering the conveyance speed or stopping the sheet conveyance as needed, the sheet thickness can be detected with high accuracy without causing an erroneous detection due to a shock caused by a sheet running to the swing member, even if a pressure applied from the swing member to the sheet becomes low. Even if a sheet of a type different from that specified in sheet information is conveyed due to a user's erroneous operation, a conveyance failure does not occur and the sheet thickness detection is not affected.

In the embodiments, cases have been described where the present invention is applied to the image forming apparatus or to the sheet feeding apparatus for supplying sheets to the image forming apparatus, but these are not limitative. For example, this invention is also applicable to other apparatuses such as a sheet supply apparatus for supplying sheets formed with images to a post-processing apparatus, and an inserter interposed between the image forming apparatus and the post-processing apparatus to supply a sheet into between sheets formed with images and conveyed from the image forming apparatus.

In the embodiments, cases have been described in which the driven member is implemented by the swing member whose amount of displacement can be detected in terms of pivotal motion amount (swing motion amount). Alternatively, it is possible to use a movable member which is movable in a sheet thickness direction and whose amount of displacement in the sheet thickness direction can be detected.

In the embodiments, the sheet information is set by the user. Alternatively, it can be configured that the apparatus detects a sheet property to acquire sheet information. In that case, the sheet information can be easily acquired from the detected sheet property.

In the embodiments, cases have been described in which the pressure applied to a sheet is changed in two stages according to sheet thickness. Alternatively, the pressure applied to a sheet can be changed in three or more stages according to sheet thickness or can be changed continuously according to sheet thickness.

In the embodiments, to determine whether a sheet changeover operation was made, it is determined whether the storage container was opened and closed and whether sheets were replenished. In addition, e.g., placement, replacement, removal, and remaining amount of sheets can be determined, whereby a situation where there is a fear that sheet information is erroneously set can easily be determined.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042450, filed Feb. 26, 2010, which is hereby incorporated by reference herein in its entirety.

What is claimed is:

1. A sheet thickness detection device for detecting a thickness of a sheet being conveyed, comprising:

a conveyance unit configured to convey a sheet along a conveyance path;

an acquisition unit configured to acquire information about the sheet being conveyed;

a driven member disposed in the conveyance path for contact with the sheet being conveyed and configured to be displaced to follow a thickness of the sheet being conveyed;

a pressure changeover unit configured to change a pressure applied by said driven member to the sheet being conveyed;

a displacement amount detection unit configured to detect an amount of displacement of said driven member;

a thickness computation unit configured to compute the thickness of the sheet being conveyed based on a result of detection by said displacement amount detection unit; and a control unit configured, based on the sheet information acquired by said acquisition unit, to control said pressure changeover unit to change the pressure applied by said driven member to the sheet.

2. The sheet thickness detection device according to claim 1, wherein said control unit controls said pressure changeover unit to change the pressure applied by said driven member to the sheet before the sheet is conveyed to said driven member.

3. The sheet thickness detection device according to claim 1, wherein the information about the sheet is a basis weight of the sheet, and said control unit lowers the pressure applied by said driven member to the sheet with the basis weight becoming much larger than a predetermined value.

4. The sheet thickness detection device according to claim 1, wherein said acquisition unit acquires the information about the sheet from information manually set.

5. The sheet thickness detection device according to claim 1, wherein said driven member is comprised of a swing member pivotable about a pivot shaft, one end portion of the swing member is swung to follow the thickness of the sheet being conveyed, and an amount of swing of another end portion of the swing member is detected as the amount of displacement by said displacement amount detection unit.

6. The sheet thickness detection device according to claim 5, wherein the one end portion of the swing member is comprised of a detection roller, and the detection roller is swung to follow the thickness of the sheet being conveyed.

7. The sheet thickness detection device according to claim 5, wherein said pressure changeover unit changes a tension of an elastic member connected to the other end portion of the swing member.

8. An image forming apparatus mounted with the sheet thickness detection device as set forth in claim 1 and configured to form an image on the sheet being conveyed.

9. A sheet thickness detection device for detecting a thickness of a sheet being conveyed, comprising:

a conveyance unit configured to convey a sheet along a conveyance path;

a driven member disposed in the conveyance path and configured to be displaced to follow a thickness of the sheet being conveyed;

a pressure changeover unit configured to change a pressure applied by said driven member to the sheet being conveyed;

a displacement amount detection unit configured to detect an amount of displacement of said driven member;

a thickness computation unit configured to compute the thickness of the sheet being conveyed based on a result of detection by said displacement amount detection unit; and a control unit configured to control a pressure applied to a subsequent sheet of same type based on the thickness of the sheet computed by said thickness computation unit.

10. The sheet thickness detection device according to claim 9, wherein said control unit controls said pressure changeover unit to lower the pressure applied to the subsequent sheet of same type with increasing thickness of the sheet computed by said thickness computation unit.

11. The sheet thickness detection device according to claim 9, wherein said driven member is comprised of a swing member pivotable about a pivot shaft, one end portion of the swing member is swung to follow the thickness of the sheet being conveyed, and an amount of swing of another end portion of the swing member is detected as the amount of displacement by said displacement amount detection unit.

12. The sheet thickness detection device according to claim 11, wherein the one end portion of the swing member is comprised of a detection roller, and the detection roller is swung to follow the thickness of the sheet being conveyed.

13. The sheet thickness detection device according to claim 11, wherein said pressure changeover unit changes a tension of an elastic member connected to the other end portion of the swing member.

14. An image forming apparatus mounted with the sheet thickness detection device as set forth in claim 9 and configured to form an image on the sheet being conveyed.

15. A sheet thickness detection device for detecting a thickness of a sheet being conveyed, comprising:

a storage unit configured to store sheets;

a conveyance unit configured to convey a sheet from said storage unit along a conveyance path;

a driven member disposed in the conveyance path for contact with the sheet being conveyed and configured to be displaced to follow a thickness of the sheet being conveyed;

a pressure changeover unit configured to change a pressure applied by said driven member to the sheet being conveyed;

a displacement amount detection unit configured to detect an amount of displacement of said driven member;

a thickness computation unit configured to compute the thickness of the sheet being conveyed based on a result of detection by said displacement amount detection unit;

a determination unit configured to determine whether a sheet changeover operation in said storage unit has been performed; and a control unit configured, in a case where it is determined by said determination unit that the sheet changeover operation has been performed, to control said pressure changeover unit to apply a predetermined pressure to a first sheet conveyed by said conveyance unit after determination by said determination unit and to control a pressure applied by said driven member to second and subsequent sheets based on the thickness of the first sheet computed by said thickness computation unit.

16. The sheet thickness detection device according to claim 15, wherein said control unit controls said pressure changeover unit to lower the pressure applied by said driven member to the second and subsequent sheets with increasing thickness of the first sheet computed by said thickness computation unit.

17. The sheet thickness detection device according to claim 15, wherein said driven member is comprised of a swing member pivotable about a pivot shaft, one end portion of the swing member is swung to follow the thickness of the sheet being conveyed, and an amount of swing of another end portion of the swing member is detected as the amount of displacement by said displacement amount detection unit.

18. The sheet thickness detection device according to claim 17, wherein said pressure changeover unit changes a tension of an elastic member connected to the other end portion of the swing member.

19. The sheet thickness detection device according to claim 15, wherein based on at least one of said storage unit being opened and closed, sheets being placed in, replaced in, replenished in, and removed from said storage unit and a remaining amount of sheets in said storage unit, said determination unit determines that the sheet changeover operation was performed.

20. The sheet thickness detection device according to claim 15, wherein in a case where it is determined by said determination unit that the sheet changeover operation was performed, said control unit sets a conveyance speed of a sheet conveyed by said conveyance unit after determination by said determination unit lower than a predetermined speed or stops conveyance of the sheet.

21. An image forming apparatus mounted with the sheet thickness detection device as set forth in claim 15 and configured to form an image on the sheet being conveyed.

* * * * *